US012589912B2

(12) United States Patent
Noguchi et al.

(10) Patent No.: US 12,589,912 B2
(45) Date of Patent: Mar. 31, 2026

(54) PRODUCT-CONTAINING OUTER BAG, BAG FEEDING DEVICE, AND SUPPLY METHOD

(71) Applicant: SEISAN NIPPONSHA, LTD., Tokyo (JP)

(72) Inventors: Takayuki Noguchi, Tokyo (JP); Tatsuya Kudama, Chiyoda-ku (JP)

(73) Assignee: SEISAN NIPPONSHA, LTD., Tokyo (JP)

( * ) Notice: Subject to any disclaimer, the term of this patent is extended or adjusted under 35 U.S.C. 154(b) by 91 days.

(21) Appl. No.: 18/546,701

(22) PCT Filed: Jan. 6, 2022

(86) PCT No.: PCT/JP2022/000198
§ 371 (c)(1),
(2) Date: Aug. 16, 2023

(87) PCT Pub. No.: WO2022/201734
PCT Pub. Date: Sep. 29, 2022

(65) Prior Publication Data

US 2024/0124170 A1 Apr. 18, 2024

(30) Foreign Application Priority Data

Mar. 26, 2021 (JP) ..... 2021-053088

(51) Int. Cl.
*B65B 25/14* (2006.01)
*B65B 5/06* (2006.01)
(Continued)

(52) U.S. Cl.
CPC ..... *B65D 33/001* (2013.01); *B65B 5/067* (2013.01); *B65B 25/14* (2013.01); *B65B 43/18* (2013.01);
(Continued)

(58) Field of Classification Search
CPC ..... B65B 5/067; B65B 25/14; B65B 43/12; B65B 43/14; B65B 43/18; B65B 69/0008;
(Continued)

(56) References Cited

U.S. PATENT DOCUMENTS 2,811,280 A * 10/1957 Commisso ..... B65D 83/0894 221/302
4,216,863 A * 8/1980 Seymour-Smith ..... B65D 75/5833 206/526
(Continued)

FOREIGN PATENT DOCUMENTS

CN 102975881 A 3/2013
CN 106535851 A 3/2017
(Continued)

OTHER PUBLICATIONS

International Search Report dated Mar. 22, 2022 for PCT Appl. No. PCT/JP2022/000198.
(Continued)

*Primary Examiner* — Stephen F. Gerrity
(74) *Attorney, Agent, or Firm* — Ohlandt, Greeley and Perle, LLP.

(57) ABSTRACT

A product-containing outer bag in which a plurality of bags stacked in a row continuously or intermittently, with the bags, as products, partially overlapping each other, are wrapped and integrated with an outer bag, for outer packaging, having a resin film as a base material such that a state of stacking of the bags is maintained, in which the outer bag includes a first side, a second side opposite to the first side, an adhesive seal, and a thick portion disposed along an edge of the first side, and an auxiliary seal is disposed on a region (S) adjacent to a portion, of the adhesive seal, at a predetermined interval from an edge of the second side.

28 Claims, 18 Drawing Sheets

(51) Int. Cl.

| | |
|---|---|
| ***B65B 43/18*** | (2006.01) |
| ***B65B 69/00*** | (2006.01) |
| ***B65D 33/00*** | (2006.01) |
| ***B65D 33/25*** | (2006.01) |
| ***B65D 75/20*** | (2006.01) |
| ***B65D 75/58*** | (2006.01) |

(52) U.S. Cl.
CPC ..... *B65B 69/0008* (2013.01); *B65D 33/2508* (2013.01); *B65D 33/2566* (2013.01); *B65D 75/20* (2013.01); *B65D 75/5805* (2013.01)

(58) Field of Classification Search
CPC ..... B65D 33/001; B65D 33/2508; B65D 33/2566; B65D 75/20; B65D 75/5805; B65H 2701/191
USPC ..... 53/492, 381.1, 384.1; 206/554
See application file for complete search history.

(56) References Cited

U.S. PATENT DOCUMENTS

| | | | | |
|---|---|---|---|---|
| 4,718,556 | A | 1/1988 | Hildebrandt | |
| 2003/0202717 | A1* | 10/2003 | Schneider | B65D 33/2508 383/61.3 |
| 2004/0140233 | A1* | 7/2004 | Ajootian | B65D 33/14 206/461 |
| 2006/0171608 | A1* | 8/2006 | Goodman | B65D 81/02 383/41 |
| 2019/0031451 | A1* | 1/2019 | Morino | B65B 43/12 |
| 2019/0152363 | A1 | 5/2019 | Kozlowski | |

FOREIGN PATENT DOCUMENTS

| | | | | | |
|---|---|---|---|---|---|
| CN | 111319823 | A | | 6/2020 | |
| EP | 3782923 | A1 | | 2/2021 | |
| JP | 51-30081 | A | | 3/1976 | |
| JP | 58-88631 | A | | 6/1983 | |
| JP | H01111614 | A | | 4/1989 | |
| JP | H07257605 | A | * | 10/1995 | |
| JP | H0872899 | A | * | 3/1996 | B65D 33/2533 |
| JP | 2003267602 | A | | 9/2003 | |
| JP | 2007290768 | A | * | 11/2007 | |
| JP | 2008-302962 | A | | 12/2008 | |
| JP | 2017-081588 | A | | 5/2017 | |
| JP | 2018-008728 | A | | 1/2018 | |
| JP | 2018-122939 | A | | 8/2018 | |
| JP | 2018-188224 | A | | 11/2018 | |
| JP | 2018-188225 | A | | 11/2018 | |
| JP | 2018-188226 | A | | 11/2018 | |
| JP | 2018-193134 | A | | 12/2018 | |
| JP | 2018-193135 | A | | 12/2018 | |
| JP | 2019-94148 | A | | 6/2019 | |
| JP | 2019189355 | A | * | 10/2019 | |
| WO | 2015-190970 | A1 | | 12/2015 | |

OTHER PUBLICATIONS

Extended European Search Report dated Feb. 3, 2025 for European Application No. EP 22 77 4539.

* cited by examiner (a)

(b)

(a)

(b)

PRODUCT-CONTAINING OUTER BAG, BAG FEEDING DEVICE, AND SUPPLY METHOD

BACKGROUND

1. Field of the Disclosure

The present disclosure relates to a product-containing outer bag, and more particularly, to a product-containing outer bag that wraps a plurality of products with a relative positional relationship between the products fixed, and that bundles them together. Furthermore, the present disclosure also relates to a bag feeding device and a supply method of supplying bags, incorporated in a product-containing outer bag, to a filling machine.

2. Discussion of the Background Art

In general, a form in which goods to be traded are directly packaged is referred to as primary packaging. A form in which goods in the form of primary packaging are further packaged in a box or a bag, in accordance with a determined quantity, is referred to as secondary packaging. The goods are delivered to the consumer in the form of primary or secondary packaging. Moreover, a form in which goods in the form of secondary packaging are placed in a packing box or the like for the purpose of bulk handling, warehousing, transportation, and the like, in accordance with a determined quantity, is referred to as tertiary packaging. Furthermore, goods in the form of primary packaging may be skipped over the form of secondary packaging to be packaged in the form of tertiary packaging.

For example, there is a technique in which a cylindrical side surface of a cylindrical small roll (falling under "goods") is wound in a packaging film, then a side surface of the packaging film is heat-sealed, and portions of the packaging film located on an upper surface side and a lower surface side of the cylinder are closed and heat-sealed to primarily package the small roll (See, for example, FIGS. 25 to 29 of Patent Literature 1).

Further, since goods to be traded by bag manufacturers are bags as packaging material (See, for example, Patent Literature 2), in the present specification, the bags as packaging material, which are goods to be traded, may be referred to as "products" in order to distinguish the bags from goods that are not packaging material (They are normal goods, and hereinafter also referred to as non-packaging material goods). Furthermore, the packaging that wraps the bags may be referred to as an outer bag.

Before a bag with a fitting tool containing the non-packaging material goods is displayed in a retail store, there is usually a route along which first, (1) in a bag making process, bags are manufactured and contained in an outer bag by a bag manufacturer, (2) in a transportation process 1, the bags are delivered to a manufacturer of the non-packaging material goods, (3) in a bag feeding process, the bags are taken out from the outer bag, (4) in a filling process, the non-packaging material goods are filled in the bags, and (5) in a transportation process 2, the non-packaging material goods filled in the bags are conveyed to the retail store to pass to a general consumer.

The conventional bag making process has been performed in the following procedure. Thereat, bags with a fitting tool, as products made by a bag making machine, have been temporarily stocked in a container such as a tray, and manually bunched to be bunches composed of a certain number of bags each. The bunches of bags with fitting tools where each of the bunches has a certain number of bags, as products, are fixed by binding means such as rubber bands, and subsequently put into outer bags each having a fitting tool, and then the fitting tool of each of the outer bags is closed. Moreover, the plurality of outer bags each having the fitting tools are packed in a box. The box is shipped after being covered with a waterproof film to prevent adhesion of dust and dirt or to prevent water immersion. All of these steps have required factory hands.

Furthermore, the conventional bag feeding process is performed in the following procedure. That is, in order to fill the non-packaging material goods into the bags with the fitting tools, the manufacturer of the non-packaging material goods peels off the waterproof film, takes out the outer bag from the box, removes the fitting tool of the outer bag, takes out the bundled bags with the fitting tools, removes the binding means such as a rubber band, and restores the bags with the fitting tools to a loose state. All these steps also required factory hands.

Furthermore, the conventional filling process is performed in the following procedure. That is, the loose bags with the fitting tools are supplied to a bag supply unit of a filling machine. This step also required factory hands. The bags with the fitting tools taken out one by one from the bag supply unit of the filling machine are opened and filled with the non-packaging material goods. This step is performed by the filling machine.

Conventionally, bags, which are products sent out from the bag making machine, are collected and bundled by a staff. The bag bundle is boxed in cardboard or the like manually. In a product-containing outer bag, there is a risk that the bags, which are products contained in the outer bag, become biased, such a risk that the bags are displaced inside the outer bag and stacked unbalancedly, especially during transportation. When a bag bundle bound at the time of boxing is erroneously folded and packed, or bags as products are bent, wrinkled or warped due to external pressure, etc., or the like occurs, upon applying the bags as products to a content filling machine, a problem that the bags as products cannot be sucked by a suction board or the like and cannot be supplied to the filling machine occurs. Assuming this problem, it is always necessary to keep personnel in charge.

Furthermore, upon supplying the bags as products to the filling machine, it takes time and effort to take out the product-containing outer bag from the cardboard or the like manually and to make personnel, who align the bags as products carefully, tied up keeping normal operation of the filling machine. Depending on the type of the filling machine, the bags have to be bound in a fan shape, a flat shape, or other required shapes, and it is necessary to secure skilled personnel. Furthermore, it takes time and effort to change a boxing form for each required shape. Due to such various boxing forms, in addition to a burden on personnel and a temporal load, a space in the box and a dead space are generated, and thus transportation cost is also increased.

Upon delivering the bag bundle in cardboard, fine dust or fine foreign matter may be mixed, or the bags may be damaged by weather such as rain or snow. Upon removing the bag binding, due to usage of a cutter, scissors, or the like, the bags may be damaged to suffer a loss. The labor shortage has put a heavy burden on personnel, and at the same time, an increase in labor cost has become a problem. Since the speed of the bag making machine is adjusted in accordance with the bag binding speed of the personnel involved with the bag making machine, the production efficiency depends on the individual skill of personnel, and the productivity is poor and there is unevenness.

In order to save human labor, the present applicant has proposed a product-containing outer bag in which an outer bag for outer packaging is formed in the form of a cylindrical outer bag with a fitting tool or a cylindrical outer bag, and a plurality of bags, as products, stacked in a row in succession, with the bags partially overlapping each other, are wrapped and integrated with the cylindrical outer bag with the fitting tool for exterior or the cylindrical outer bag for exterior such that a stacked state of the bags is maintained (See, for example, Patent Literatures 3 to 8).

CITATION LIST

Patent Literature

Patent Literature 1: JP 2003-267602 A
Patent Literature 2: JP 2018-8728 A
Patent Literature 3: JP 2018-122939 A
Patent Literature 4: JP 2018-188224 A
Patent Literature 5: JP 2018-188225 A
Patent Literature 6: JP 2018-188226 A
Patent Literature 7: JP 2018-193134 A
Patent Literature 8: JP 2018-193135 A

SUMMARY

Technical Problem

In the product-containing outer bag, it is desirable to automatically perform from bag making to boxing without any trouble and to automatically perform from unpacking to supplying to filling machine without any trouble. In Patent Literatures 3 to 8, automation from unpacking to supplying to filling machine is not studied.

Therefore, an object of the present disclosure is to provide a product-containing outer bag, a bag feeding device, and a supply method (1) which save manpower in bag making, boxing, and bag feeding process, make an error in supply in the bag feeding process preventable, and are feasible for space saving, (2) which provide an innovative product delivery form in consideration of a reusable environment, and (3) which are capable of automation from bag making to boxing without any trouble, and are capable of automation from unpacking to supplying to filling machine without any trouble.

Solution to Problem

A product-containing outer bag according to the present disclosure is a product-containing outer bag in which a plurality of bags, as products, stacked in a row continuously or intermittently, with the bags partially overlapping each other, are wrapped and integrated with an outer bag, for outer packaging, having a resin film as a base material such that a state of stacking the bags is maintained, in which the outer bag includes: a first side; a second side opposite to the first side; an adhesive seal connecting an end of the first side and an end of the second side opposite to each other; and a held portion that is held upon supporting the product-containing outer bag in a state of being suspended such that the second side is below the first side.

In the product-containing outer bag according to the present disclosure, an auxiliary seal is preferably disposed on a region adjacent to a portion, of the adhesive seal, at a predetermined interval from an edge of the second side.

In the product-containing outer bag according to the present disclosure, the outer bag preferably further includes a thick portion disposed along an edge of the first side.

In an embodiment of the product-containing outer bag according to the present disclosure, the outer bag includes a first opening opened along an edge of the first side, and a first fitting tool disposed, as the thick portion, on an inner wall side of the base material along an edge of the first opening, and the first fitting tool is engaged.

In an embodiment of the product-containing outer bag according to the present disclosure, the outer bag includes a second opening opened along an edge of the second side and an easy peel seal sealing the second opening.

In an embodiment of the product-containing outer bag according to the present disclosure, the outer bag includes a perforation along an edge of the second side.

In the product-containing outer bag according to the present disclosure, it is preferable that the outer bag further includes a first opening opened along an edge of the first side, a first fitting tool disposed, as the thick portion, on an inner wall side of the base material along an edge of the first opening, a second opening opened along an edge of the second side, and a second fitting tool disposed on an inner wall side of the base material along an edge of the second opening, the first fitting tool and the second fitting tool are engaged with each other, and one or both of the first fitting tool and the second fitting tool include a weak engagement portion in one or both of portions adjacent to the adhesive seal. It is possible to weaken the impact at the time of opening by opening the weak engagement portion with a suction board or the like of the bag feeding device. Furthermore, since the bags can be taken out by the opening of the second fitting tool, the outer bag can be opened without using a knife. As a result, there is no possibility of damaging the bags as products, and product loss can be prevented.

In an embodiment of the product-containing outer bag according to the present disclosure, the outer bag includes a perforation extending, in parallel with the first fitting tool, on a side closer to the second side than the first fitting tool, or a perforation extending, in parallel with the second fitting tool, on a side closer to the first side than the second fitting tool.

In the product-containing outer bag according to the present disclosure, with the proviso that a distance between an edge of the first side and the thick portion is d1, and a distance between an edge of the second side and the second fitting tool is d2, it is preferable that a relationship of $d1<d2$ is satisfied. By making d2 longer, the base material between the edge of the second side and the second fitting tool is easily sucked by a sucker provided in the bag feeding device, and the second opening is more easily opened.

In the product-containing outer bag according to the present disclosure, the outer bag includes a standing portion that is positioned at a portion sandwiched between the first side and the second side and is parallel to the first side and the second side.

In the product-containing outer bag according to the present disclosure, the outer bag preferably further includes a thick portion disposed along an edge of the standing portion.

In the product-containing outer bag according to the present disclosure, the outer bag preferably includes a portion where inner walls of the base material are in contact with each other. The bags are fixed in the outer bag, and occurrence of an error in supply can be prevented in a bag feeding step.

A bag feeding device according to the present disclosure is a bag feeding device that sequentially supplies to a filling machine a plurality of bags, as products, incorporated in a product-containing outer bag in which the plurality of bags stacked in a row continuously or intermittently, with the bags partially overlapping each other, are wrapped and integrated with an outer bag, for outer packaging, having a resin film as a base material such that a state of stacking the bags is maintained, the bag feeding device including: a holding instrument that supports the product-containing outer bag in a suspended state; an opening instrument that opens a lower end of the product-containing outer bag supported in a suspended state; a receiving instrument that receives the plurality of bags coming out of the outer bag; an alignment instrument that aligns the plurality of bags; and a supply instrument that supplies the aligned bags to the filling machine.

In an embodiment of the bag feeding device according to the present disclosure, the holding instrument is a clamping arm.

In an embodiment of the bag feeding device according to the present disclosure, the holding instrument is a suction arm.

In an embodiment of the bag feeding device according to the present disclosure, the receiving instrument is a guide rail that holds and transfers the plurality of bags in a standing state, and the guide rail also serves as the alignment instrument.

In an embodiment of the bag feeding device according to the present disclosure, the receiving instrument is a belt conveyor, and the alignment instrument is an alignment rib extending on a conveyance surface of the belt conveyor and in a flow direction of the belt conveyor.

In an embodiment of the bag feeding device according to the present disclosure, the receiving instrument is a belt conveyor, and the alignment instrument is an alignment guide that corrects a posture of each of the bags conveyed by the belt conveyor.

A supply method according to the present disclosure is a supply method of supplying the bags with the bag feeding device according to the present disclosure, the supply method including: a step A of supporting the product-containing outer bag in a suspended state by the holding instrument; a step B of opening the lower end of the product-containing outer bag by the opening instrument to drop the plurality of bags; a step C of receiving the plurality of dropped bags by the receiving instrument; a step D of aligning the plurality of bags in a line by the alignment instrument; and a step E of sequentially supplying the bags aligned in a line to the filling machine by the supply instrument.

In an embodiment of the supply method according to the present disclosure, the bag feeding device includes a clamping arm as the holding instrument, and the step A is a step of clamping the product-containing outer bag with the clamping arm.

In an embodiment of the supply method according to the present disclosure, the bag feeding device includes a suction arm as the holding instrument, and the step A is a step of sucking the product-containing outer bag with the suction arm.

In an embodiment of the supply method according to the present disclosure, the bag feeding device includes a guide rail, as the receiving instrument, holding and transferring the plurality of bags in a standing state, and the step C and the step D are steps of simultaneously receiving and aligning the plurality of bags by the guide rail.

In an embodiment of the supply method according to the present disclosure, the bag feeding device includes a belt conveyor as the receiving instrument, and an alignment rib, as the alignment instrument, extending on a conveyance surface of the belt conveyor and in a flow direction of the belt conveyor, and the step C and the step D are steps of receiving the plurality of bags by the belt conveyor and bringing the plurality of bags into contact with the alignment rib and aligning the plurality of bags, simultaneously.

In an embodiment of the supply method according to the present disclosure, the bag feeding device includes a belt conveyor as the receiving instrument, and an alignment guide, as the alignment instrument, correcting a posture of each of the bags conveyed by the belt conveyor, the step C is a step of receiving the plurality of bags by the belt conveyor, and the step D is a step of bringing the bags into contact with the alignment guide and aligning the bags.

Advantageous Effects of Disclosure

According to the present disclosure, the present disclosure can provide a product-containing outer bag, a bag feeding device, and a supply method (1) which save manpower in bag making, boxing, and bag feeding process, make occurrence of an error in supply in the bag feeding process preventable, and are feasible for space saving, (2) which provide an innovative product delivery form in consideration of a reusable environment, and (3) which are capable of automation from bag making to boxing without any trouble, and are capable of automation from unpacking to supplying to filling machine without any trouble.

DETAILED DESCRIPTION OF THE PREFERRED EMBODIMENT

Figure 1:
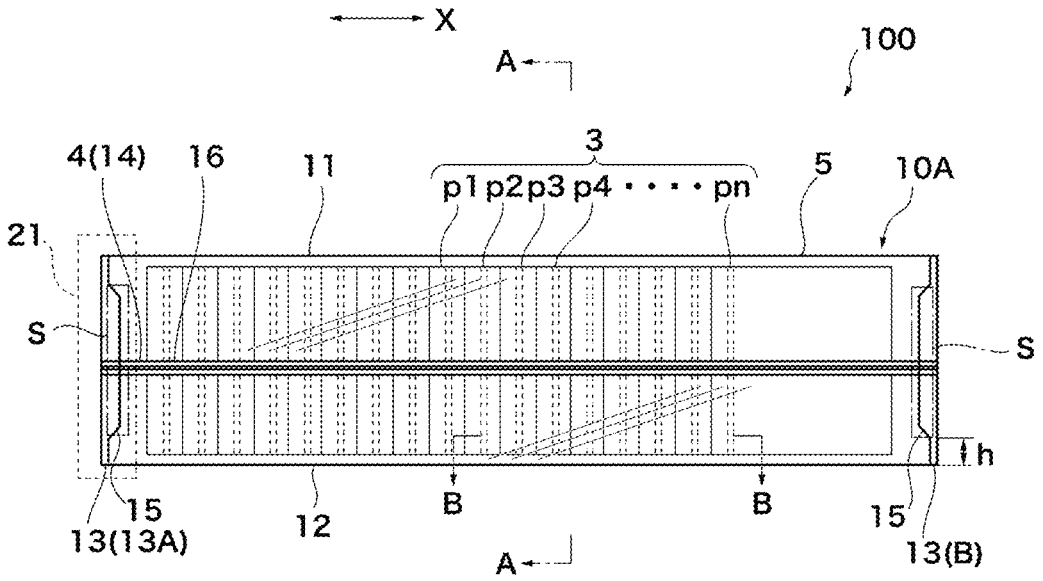
FIG. 1 is a schematic front view illustrating a first example of a product-containing outer bag according to the present embodiment.

Next, the present disclosure will be described in detail with reference to embodiments, but the present disclosure is not construed as being limited to these descriptions. The embodiment may be variously modified as long as the effect of the present disclosure is exhibited.

A product-containing outer bag according to the present embodiment is a product-containing outer bag in which a plurality of bags, as products, stacked in a row continuously or intermittently, with the bags partially overlapping each other, are wrapped and integrated with an outer bag, for outer packaging, having a resin film as a base material such that a state of stacking the bags is maintained, in which the outer bag includes a first side, a second side opposite to the first side, an adhesive seal that connects an end of the first side and an end of the second side opposite to each other, and a held portion that is held upon supporting the outer bag in a state of being suspended such that the second side is below the first side. The product-containing outer bag according to the present embodiment includes a form in which the held portion is a surface of the base material and a form in which the held portion is a thick portion.

Product-Containing Outer Bag: First Example

A product-containing outer bag (first example) according to the present embodiment will be described with reference to FIGS. 1 to 3. A product-containing outer bag 100 (first example) according to the present embodiment is a product-containing outer bag in which a plurality of bags 3 stacked in a row continuously or intermittently, with the bags (p1, p2, p3, p4, . . . , pn), as products, partially overlapping each other, are wrapped and integrated with an outer bag, for outer packaging, having a resin film as a base material 5 such that a state of stacking the bags 3 is maintained, in which the outer bag 10A includes: a first side 11, a second side 12 opposite to the first side 11, an adhesive seal 13 that connects an end of the first side 11 and an end of the second side 12 opposite to each other; a standing portion 16 that is positioned at a portion sandwiched between the first side 11 and the second side 12 and is parallel to the first side 11 and the second side 12; and a thick portion 4 disposed along an edge of the standing portion 16, and an auxiliary seal 15 is disposed on a region S adjacent to a portion of the adhesive seal 13, at a predetermined interval h from an edge of the second side 12.

A material of the resin film as the base material 5 is, for example, a polyethylene resin or a polypropylene resin, and any material is adopted from those exemplified in the following <1> to <29>, but is not particularly limited in the present embodiment.

<1> High-density polyethylene (HDPE)
<2> Medium-density polyethylene (MDPE)
<3> Low-density polyethylene (LDPE)
<4> Polypropylene (PP)
<5> Polyvinylidene chloride (PVDC)
<6> Polyvinyl chloride (PVC)
<7> Polystyrene (PS)
<8> Polyvinyl acetate (PVAc)
<9> Polytetrafluoroethylene (PTFE)
<10> Acrylonitrile butadiene styrene resin (ABS resin)
<11> AS resin (SAN)
<12> Acrylic resin (PMMA)
<13> Polyamide (PA)/trade name nylon
<14> Polyacetal (POM)
<15> Polycarbonate (PC)
<16> Modified polyphenylene ether (m-PPE, modified PPE, PPO)
<17> Polybutylene terephthalate (PBT)
<18> Polyethylene terephthalate (PET)
<19> Cyclic polyolefin (COP)
<20> Polyphenylene sulfide (PPS)
<21> Polysulfone (PSF)
<22> Polyethersulfone (PES)
<23> Amorphous polyarylate (PAR)
<24> Liquid crystal polymer (LCP)
<25> Polyether ether ketone (PEEK)
<26> Thermoplastic polyimide (PI)
<27> Polyamideimide (PAI)
<28> Thermoplastic polyurethane (TPU)
<29> Fluororesin (PTFE)

Furthermore, a thickness of the base material 5 made of a monolayer film is desirably about 0.2 to 1.5 mm, and a thickness of the base material 5 made of a multilayer film is desirably about 0.4 to 2.0 mm.

The outer bag 10A is an outer bag for outer packaging. The outer packaging refers to a form (Both secondary and tertiary packaging are encompassed) in which goods (including not only goods but also individually primary packaged goods) to be sold are packaged together in a plurality of units. Furthermore, the outer bag means a material, particularly formed of a bag, for the outer packaging.

The outer bag 10A includes a first surface and a second surface having an inside-outside relation to the first surface. In FIG. 1, the first surface is an outer surface (surface illustrated), and the second surface is an inner surface (surface not illustrated). Note that the first surface and the second surface are names for convenience, and in FIG. 1, the outer surface may be the second surface and the inner surface may be the first surface.

The first side 11 is a side extending in an alignment direction X of the plurality of bags 3. The first side 11 may be provided with a fragile portion such as a perforation processed portion, a scratch processed portion, or a half cut processed portion.

The second side 12 is a side extending in the alignment direction X of the plurality of bags 3. The second side 12 may be provided with a fragile portion such as a perforation processed portion, a scratch processed portion, or a half cut processed portion. In the product-containing outer bag 100 of the first example, the first side 11 or the second side 12 serves as a take-out port of the plurality of bags 3 in a step of supplying the bags to a bag feeding device.

The standing portion 16 is a portion where inner wall surfaces of the base material 5 are disposed to face each other, and is positioned on a stack surface of the bags 3. As illustrated in FIG. 2, the standing portion 16 may be an opening 6, or may be provided with a hand-clasped seal (not illustrated). The standing portion 16 is a portion clamped by a clamping arm in the bag feeding device.

Figure 2:
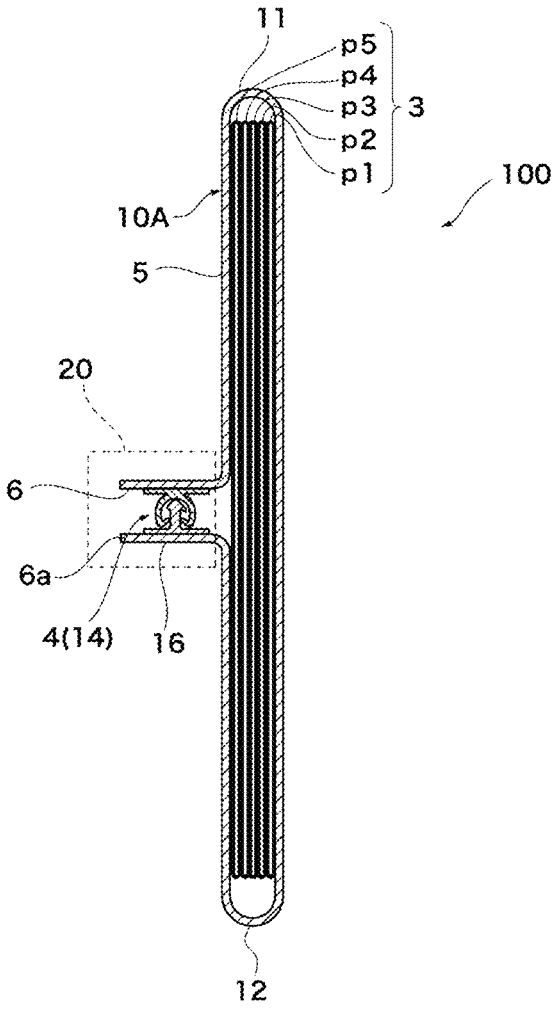
FIG. 2 is a cross-sectional view along line A-A of FIG. 1.
Figure 3:
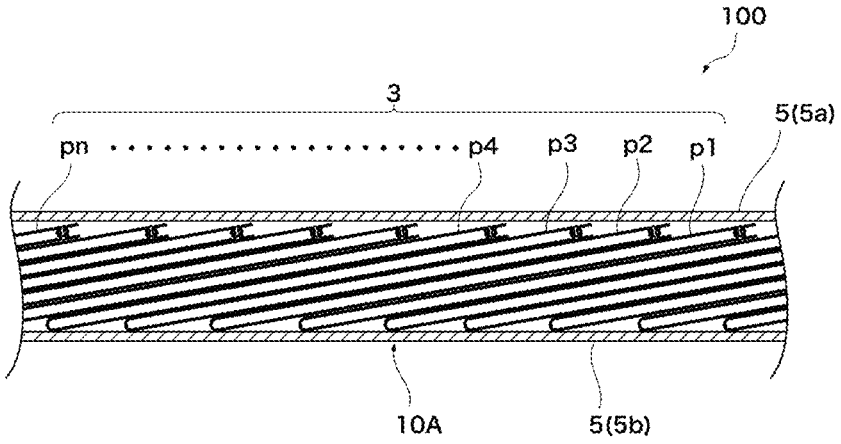
FIG. 3 is a cross-sectional view along line B-B of FIG. 1.

The thick portion 4 is a portion thicker than a peripheral portion disposed along an edge of the standing portion 16, and may be, for example, a fitting tool 14 as illustrated in FIG. 2, a rib (not illustrated), or a ridge (not illustrated). The ribs or ridges may be provided continuously or intermittently along the edge of the standing portion 16, for example. The thick portion 4 is a portion engaged with an engaging claw of the clamping arm by the bag feeding device.

In the product-containing outer bag 100 according to the present embodiment, as illustrated in FIGS. 1 and 2, the outer bag 10A includes the opening 6 opened along an edge of the standing portion 16 and the fitting tool 14 disposed as the thick portion 4 on an inner wall side of the base material 5 along an edge 6*a* of the opening 6, and the fitting tool 14 includes a form for engaging.

Figure 4:
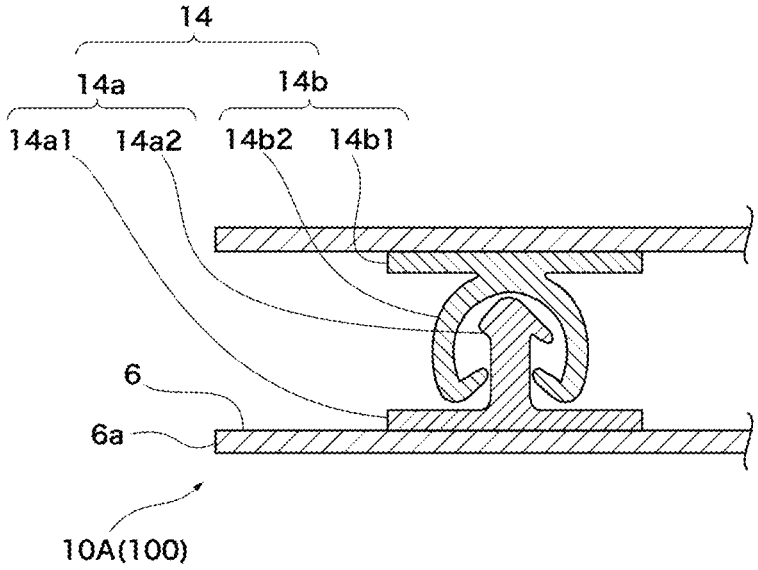
FIG. 4 is a partially enlarged view illustrating a first example of a fitting tool in a region 20 in FIG. 2.
Figure 5:
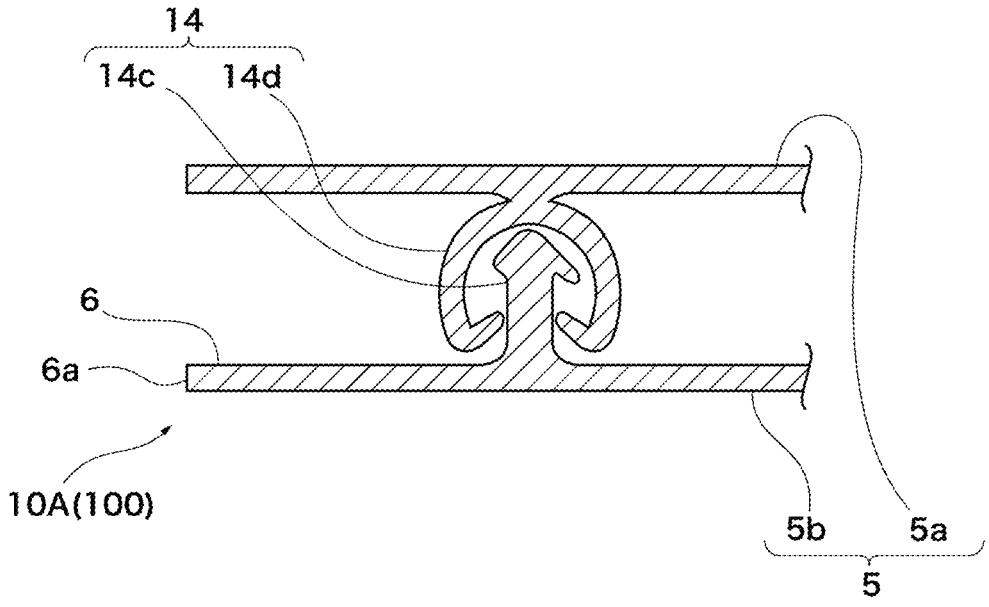
FIG. 5 is a partially enlarged view illustrating a second example of the fitting tool in the region 20 of FIG. 2.

As illustrated in FIGS. 1 and 2, the fitting tool 14 is preferably disposed on the inner wall side and along the edge 6*a* of the opening 6. The fitting tool 14 may have any structure as long as it has an openable and closable structure that is closed by being engaged and opened by being disengaged. For example, as illustrated in FIG. 4, the fitting tool 14 preferably has a chuck structure that includes a female member 14*b* having a belt-shaped female base 14*b*1 and a female portion 14*b*2 extending in the alignment direction X (illustrated in FIG. 1) of the plurality of bags 3, and a male member 14*a* having a belt-shaped male base 14*a*1 and a male portion 14*a*2 extending in the alignment direction X (illustrated in FIG. 1) of the plurality of bags 3, and that is closed upon engaging the male portion 14*a*2 with the female portion 14*b*2. The male base 14*a*1 and the female base 14*b*1 of the fitting tool 14 illustrated in FIG. 4 are bonded to the inner wall surface of the base material 5. Furthermore, as illustrated in FIG. 5, the fitting tool 14 may have a chuck structure that includes a female portion 14*d* extending in the alignment direction X (illustrated in FIG. 1) of the plurality of bags 3 and a male portion 14*c* extending in the length direction X (illustrated in FIG. 1) of the cylinder, and that is closed upon engaging the male portion 14*c* with the female portion 14*d*. The male portion 14*c* and the female portion 14*d* of the fitting tool 14 illustrated in FIG. 5 are integrally molded with the base material 5. In the present embodiment, the fitting tool 14 is not limited to the chuck structure illustrated in FIGS. 4 and 5, and may have, for example, a structure in which female portions are engaged with each other.

As illustrated in FIG. 1, the adhesive seal 13 (13A, 13B) includes a left adhesive seal 13A connecting a left end of the first side 11 and a left end of the second side 12, and a right adhesive seal 13B connecting a right end of the first side 11 and a right end of the second side 12. The adhesive seal 13 (13A, 13B) is preferably a sealing seal that seals both sides connecting the end of the first side 11 and the end of the second side 12 opposite to each other. The sealing seal is preferably, for example, an adhesive portion or a heat welded portion between the base materials 5 opposite to each other. The adhesive seal 13 (13A, 13B) is preferably provided across the thick portion 4 (the fitting tool 14 in FIG. 1). A distance between the left adhesive seal 13A and the right adhesive seal 13B is not particularly limited, and is, for example, 10 to 300 cm. Although FIG. 1 illustrates a form in which the adhesive seal is a sealing seal as an example, the present disclosure is not limited thereto, and the adhesive seal may be a spot seal. Furthermore, the adhesive seal may be, for example, a thermal seal with reduced seal strength, such as a low-temperature thermal seal. The adhesive seal encompasses a thermal seal using a heat sealer or the like, and an ultrasonic seal using an ultrasonic welder or the like.

Figure 8:
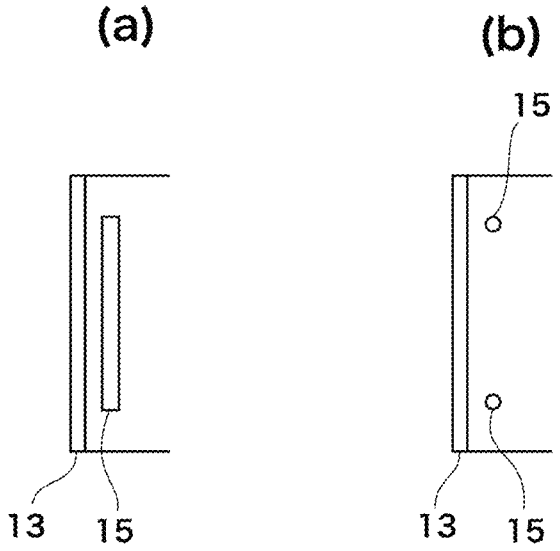
FIGS. 8(*a*) and 8(*b*) are partial enlarged views illustrating another example of an auxiliary seal in a region 21 of FIG. 1, in which FIG. 8(*a*) illustrates a first example and FIG. 8(*b*) illustrates a second example.

The auxiliary seal 15 is an adhesive portion or a heat welded portion between the base materials 5 opposite to each other, and is a seal for securing a distance between each bag, arranged at both ends in the alignment direction X, of the plurality of bags 3 and the adhesive seal 13. When the bag is in contact with the adhesive seal 13, there is a possibility that the bags 3 are caught at an intersection portion between the adhesive seal 13 and the second side 12 upon taking out the plurality of bags 3 from a side of the second side 12 of the outer bag 10 by the bag feeding device. However, providing the auxiliary seal 15 can prevent the bags 3 from being caught and further ensure bag feeding. The auxiliary seal 15 is preferably disposed on a region S adjacent to a portion of the adhesive seal 13, at a predetermined interval h from the edge of the second side 12. The predetermined interval h is not particularly limited, and is, for example, 1 to 20 mm. The auxiliary seal 15 may be disposed integrally with the adhesive seal 13 as illustrated in FIG. 1, or may be provided separately from the adhesive seal 13 as illustrated in FIGS. 8(*a*) and 8(*b*). When the auxiliary seal 15 is disposed integrally with the adhesive seal 13, the auxiliary seal 15 preferably has a trapezoidal shape protruding from the adhesive seal 13 toward the inside of the outer bag 10A, for example, as illustrated in FIG. 1. A width of the protruding portion is preferably wider than a width of the adhesive seal 13. When the auxiliary seal 15 is provided separately from the adhesive seal 13, the auxiliary seal 15 may be, for example, a quadrangular seal arranged in parallel with the adhesive seal 13 as illustrated in FIG. 8(*a*), or a plurality of point-like seals arranged in parallel with the adhesive seal 13 as illustrated in FIG. 8(*b*). Note that in FIGS. 8(*a*) and (*b*), the standing portion 16 is not illustrated.

Figure 6:
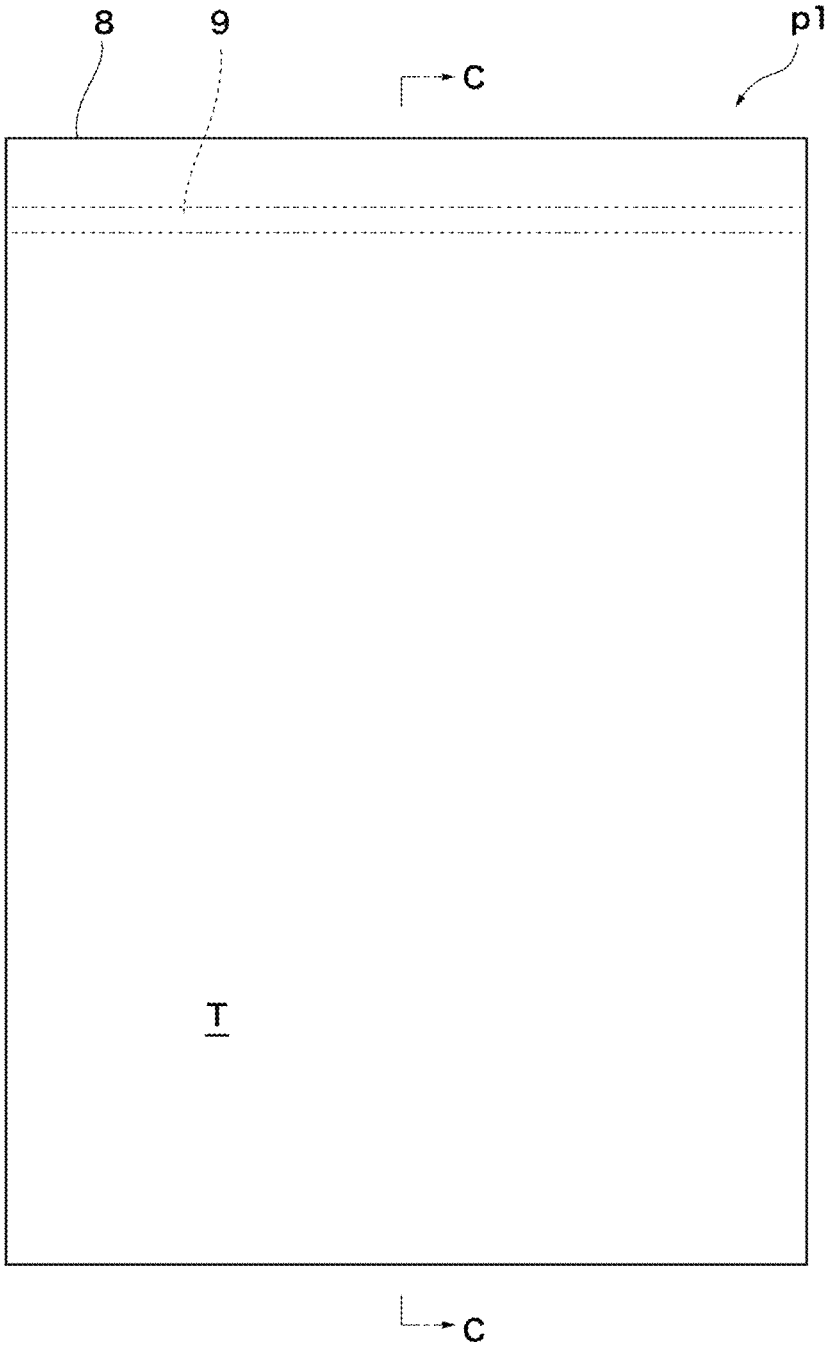
FIG. 6 is a schematic front view illustrating one form of bags incorporated in the product-containing outer bag according to the present embodiment.
Figure 7:
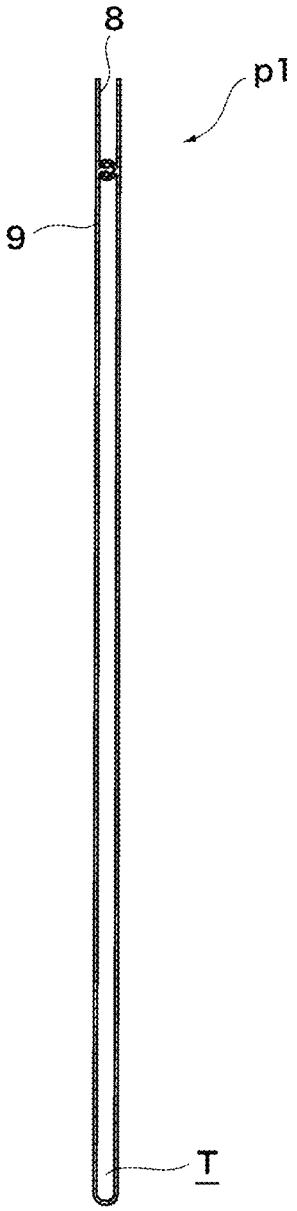
FIG. 7 is a cross-sectional view along line C-C of FIG. 6.

In the product-containing outer bag 100 according to the present embodiment, a plurality of bags, as products, are contained inside the outer bag 10A. As illustrated in FIGS. 6 and 7, a bag p1 as a product is a plastic resin bag having an opening 8 and a containing portion T, and a chuck 9 is provided along an end of opening 8. The chuck 9 has a fitting structure, for example, has the same structure as the fitting tool 14 of the outer bag 10A, and is openable and closable. Bags p2, p3, p4, . . . , pn as products are bags having the same structure as the bag p1. Since the bags (p1, p2, p3, p4, . . . , pn) as products have a flat structure, a state as illustrated in FIG. 3, where the plurality of bags 3 stacked in a line so as to partially overlap each other, can be set. It is preferable that the plurality of bags 3 are stacked in a row with their ends shifted from each other along the length direction X of the cylinder. The edge is, for example, an edge of the opening 8 (illustrated in FIG. 7) of the bag p1 or left and right side ends of the bag p1. Here, the plurality of bags 3 may be arranged continuously along the alignment direction X of the bags 3 in the outer bag 10A, or may be arranged intermittently, that is, may be arranged having discontinuities in the middle.

Preferably, the intermittent arrangement is, for example, an arrangement in which a predetermined number of bags are stacked in a row so as to partially overlap each other, a gap is then provided, and subsequently the same number of bags are stacked in a row so as to partially overlap each other, a gap is then provided again, and the above is repeated. It is easy to confirm the number of bags. In the present embodiment, since the plurality of bags 3 are stacked in a line so as to partially overlap and are integrated to get a form in the product-containing outer bag 100, they may be simply referred to as "a plurality of bags 3" or "bags 3".

As illustrated in FIG. 2, the product-containing outer bag 100 encloses the plurality of bags 3 with the outer bag 10A. Here, a width of the outer bag 10A, with the plurality of bags 3 contained therein, is preferably slightly larger than a width of the plurality of bags 3, for example, preferably 1 to 10 mm larger. Thereat, the outer bag 10A preferably has a holding force to the extent that the arrangement of the plurality of bags 3 does not collapse during closure of the fitting tool 14. This allows further integration such that the stacked state of the bags 3 is maintained, and this allows control of an increase in volume since extra air does not enter the inside of the outer bag 10A.

The product-containing outer bag 100 not only enables handling of the plurality of bags 3 as a bulk in carrying, storing, or both, but also enables fixing of the arrangement state of the bags sequentially manufactured from the bag making machine, so that it is possible to substantially reproduce in-line operation even though the bag making machine and the filling machine are in different places.

In the product-containing outer bag 100 of the first example, when the thick portion 4 is the first fitting tool 14, the outer bag 10A is preferably integrated in a state of containing the bags 3 by the plurality of bags 3 wrapped, in the form of butt seaming, with one base material 5, and by the first fitting tool 14, which is the thick portion 4, positioned on and engaged with the stacking surface of the bags 3. Thereat, the male portion 14*a*2 and the female portion 14*b*2 of the first fitting tool 14 may be thermally fused. Furthermore, in the product-containing outer bag 100 according to the first example, when the thick portion 4 is a rib (not illustrated) or a ridge (not illustrated), the outer bag 10A may be integrated in a state of containing the bags 3 by the plurality of bags 3 wrapped with one base material 5, in the form of butt seaming, and by the rib or the ridge, which is the thick portion 4, positioned on the stacking surface of the bags 3 and hermetically sealed along the rib or the ridge. Thereat, in place of or in addition to the hermetic seal along the ribs or the ridges, the ribs or the ridges facing each other may be thermally fused.

In the product-containing outer bag 100 of the first example, the held portion may be the first surface or the second surface, or may be the standing portion 16. When the held portion is the first surface or the second surface, the bag feeding device sucks the first surface or the second surface with, for example, a suction arm, so that the product-containing outer bag 100 is supported in a suspended state. When the held portion is the standing portion 16, the bag feeding device clamps the standing portion 16 with, for example, a clamping arm, whereby the product-containing outer bag 100 is supported in a suspended state.

Product-Containing Outer Bag: Second Example

Figure 9:
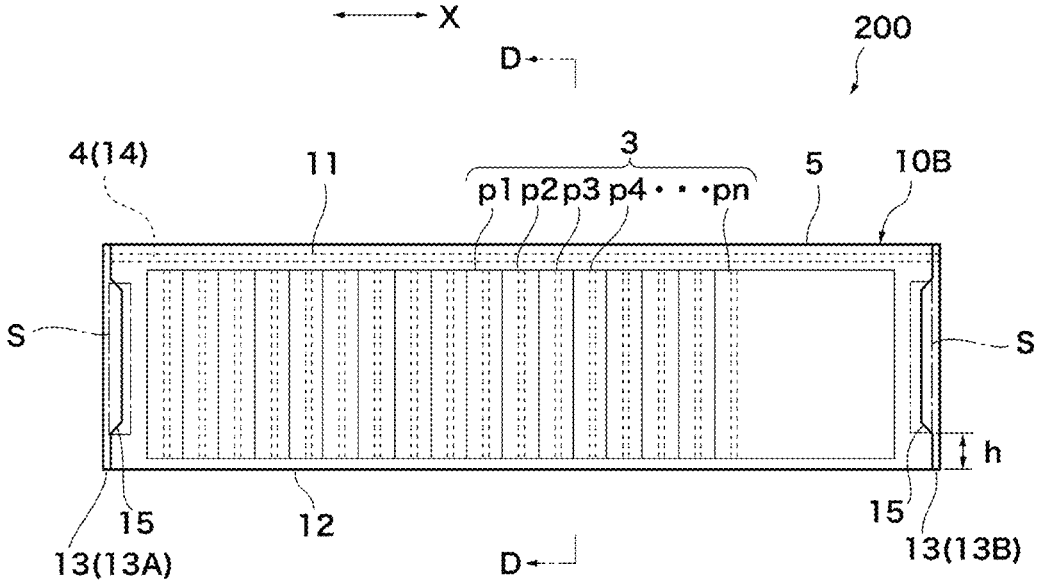
FIG. 9 is a schematic front view illustrating a second example of the product-containing outer bag according to the present embodiment.
Figure 10:
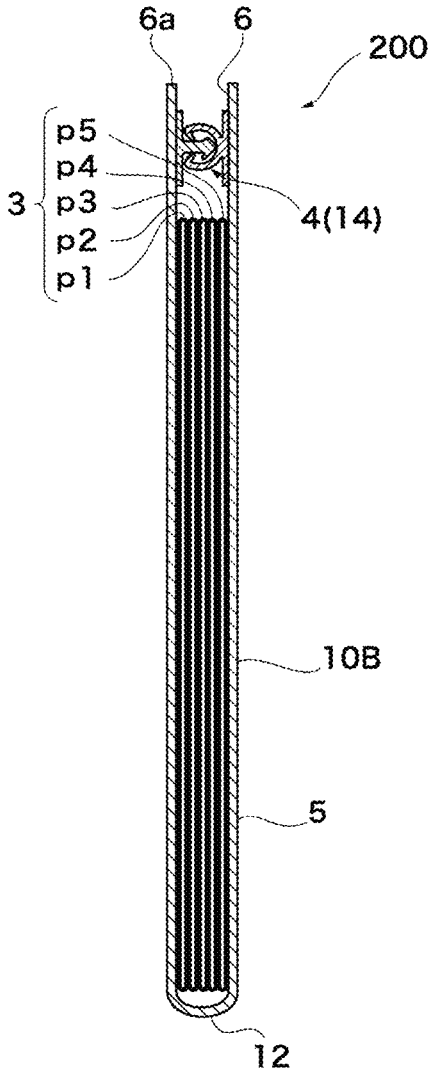
FIG. 10 is a cross-sectional view along line D-D of FIG. 9.

Next, a product-containing outer bag 200 (second example) according to the present embodiment will be described with reference to FIGS. 9 and 10. As illustrated in FIGS. 9 and 10, the outer product-containing bag 200 according to the present embodiment is a product-containing outer bag in which a plurality of bags 3 stacked in a row continuously or intermittently, with the bags (p1, p2, p3, p4, . . . , pn) as products partially overlapping each other, are wrapped and integrated with an outer bag 10B, for outer packaging, having a resin film as a base material 5 such that a state of stacking the bags (p1, p2, p3, p4, . . . , pn) is maintained, in which the outer bag 10B includes a first side 11, a second side 12 opposite to the first side 11, an adhesive seal 13 connecting an end of the first side 11 and an end of the second side 12 opposite to each other, and a thick portion 4 disposed along an edge, of the first side 11, and an auxiliary seal 15 is disposed on a region S adjacent to a portion of the adhesive seal 13, at a predetermined interval from an edge of the second side 12.

The product-containing outer bag 200 of the second example has the same basic structure as the product-containing outer bag 100 of the first example, except that a position of the thick portion 4 is different. Therefore, the description of the common structure is omitted.

In the product-containing outer bag 200 according to the present embodiment, the thick portion 4 is disposed along an edge of the first side 11. As illustrated in FIGS. 9 and 10, it is preferable that the outer bag 10B includes a first opening 6 opened along the edge of the first side 11 and a fitting tool 14 disposed, as the thick portion 4, on an inner wall side of the base material 5 and along an edge 6*a* of the first opening 6, and the fitting tool 14 includes a form for engaging.

In the product-containing outer bag 200 of the second example, the first side 11 may have the first opening 6 as illustrated in FIGS. 9 and 10, or may have a hermetic seal portion (not illustrated). A peripheral portion of the first side 11 is a portion clamped by the clamping arm of the bag feeding device.

In the product-containing outer bag 200 of the second example, the second side 12 is a folded portion in which one base material 5 is folded back along the alignment direction X of the plurality of bags 3 as illustrated in FIGS. 9 and 10. The second side 12 may be provided with a fragile portion such as a perforation processed portion, a scratch processed portion, or a half cut processed portion. The second side 12 serves as a take-out port for the plurality of bags 3 in the step of supplying the bags to the bag feeding device.

In the product-containing outer bag 200 of the second example, when the thick portion 4 is the first fitting tool 14, the outer bag 10B is preferably integrated in a state of containing the bags 3 by the bags 3 wrapped with one half-folded base material 5, and by the first fitting tool 14, which is the thick portion 4, positioned on and engaged with a side of either the left or right side end of the bags 3. Furthermore, in the product-containing outer bag 200 of the second example, when the thick portion 4 is a rib (not illustrated) or a ridge (not illustrated), the outer bag 10B may be integrated in a state of containing the bags 3 by the plurality of bags 3 wrapped with one half-folded base material 5, and by the rib (not illustrated) or the ridge (not illustrated), which is the thick portion 4, positioned on a side of either the left or right side end of the bags 3 and hermetically sealed along the rib or the ridge.

In the product-containing outer bag 200 of the second example, the held portion is a peripheral portion of the first side 11. The peripheral portion of the first side 11 is a portion having a predetermined width from the first side 11 of the first surface and the second surface. For example, the bag feeding device clamps the peripheral portion of the first side 11 with a clamping arm or sucks the peripheral portion with a suction arm, whereby the product-containing outer bag 200 is supported in a suspended state. Furthermore, in the product-containing outer bag 200 of the second example, the held portion may be a peripheral portion of the second side 12. Thereat, the bag feeding device sucks the peripheral portion of the second side 12 with the suction arm, so that the product-containing outer bag 200 is supported in a suspended state.

Product-Containing Outer Bag: Third Example

Next, a product-containing outer bag 300 (third example) according to the present embodiment will be described with reference to FIGS. 11 and 12. In the product-containing outer bag 300 (third example) according to the present embodiment, it is preferable that an outer bag 10C further includes a first opening 6 that opens along an edge of the first side 11, a first fitting tool 14, as the thick portion 4, disposed on an inner wall side of the base material 5 and along an edge 6*a* of the first opening 6, a second opening 7 that opens along an edge of the second side 12, and a second fitting tool 24 that is disposed on an inner wall side of the base material 5 and along an edge 7*a* of the second opening 7, the first fitting tool 14 and the second fitting tool 24 are engaged with each other, and one or both of the first fitting tool 14 and the second fitting tool 24 include a weak engagement portion in one or both of portions adjacent to the adhesive seal 13. It is possible to weaken the impact at the time of opening by opening the weak engagement portion with a suction board or the like of the bag feeding device. Furthermore, since the bags 3 can be taken out by the opening of the second fitting tool 24, the outer bag can be opened without using a knife. As a result, there is no possibility of damaging the bags as a product, and product loss can be prevented.

The product-containing outer bag 300 of the third example has the same basic structure as the product-containing outer bag 200 of the second example, except that the base material 5 includes two base materials 5*a* and 5*b* overlapped with each other and that the outer bag 10B includes the second opening 7 and the second fitting tool 24 on the second side 12. Therefore, the description of the common structure is omitted.

Figure 12:
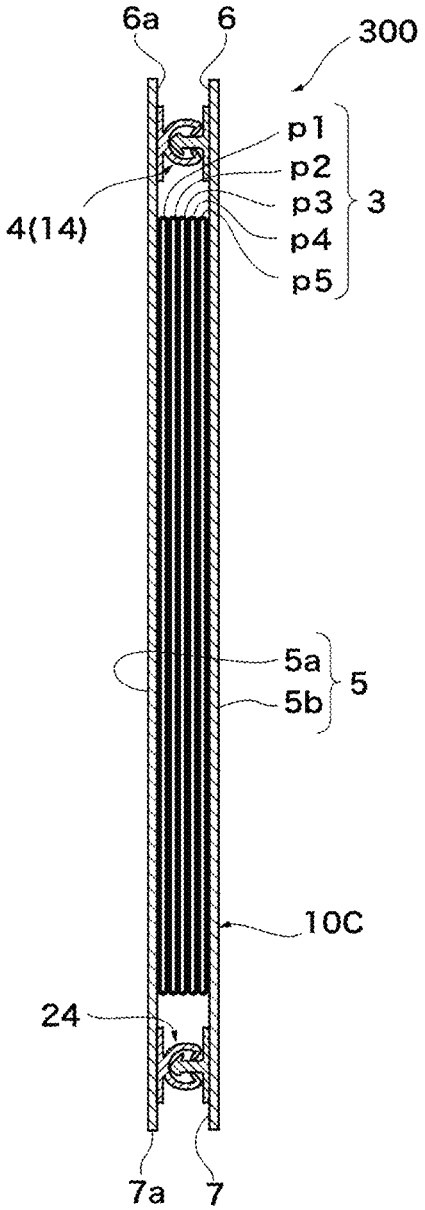
FIG. 12 is a cross-sectional view along line E-E of FIG. 11.

In the product-containing outer bag 300 of the third example, as illustrated in FIG. 12, the outer bag 10C is integrated in a state of containing the bags 3 by the plurality of bags 3 wrapped with the first base material 5*a* and the second base material 5*b* overlapped thereon, as the base material 5, and by the first fitting tool 14 and the second fitting tool 24 positioned on and engaged with the left side end side and the right side end side of the bags 3, respectively.

The second fitting tool 24 has, for example, the same structure as the fitting tool 14 of the outer bag 10A, and is openable and closable.

The weak engagement portion is a portion having a weaker engagement force than that of the surrounding engagement portions. In other words, the weak engagement portion is a portion that can be opened by releasing the engagement with a weaker force than that of the surrounding engagement portions. The engagement portion around the portions other than the weak engagement portion is a normal engagement portion, for example, a portion where the male portion 14*a*2 is engaged with the female portion 14*b*2 in the fitting tool 14 illustrated in FIG. 4. Since such a normal engagement portion is strongly engaged, the alignment of the bags 3 as products may be disturbed due to strong impact upon opening by means of a suction board or the like of the bag feeding device. However, this problem can be solved by providing a weak engagement portion. The weak engagement portion may be a portion in which the engagement between the female portion 14*b*2 and the male portion 14*a*2 is weakened by applying a pressing force from the outside to a portion of the first fitting tool 14 or the second fitting tool 24 that is desired to be the weak engagement portion to intentionally deform, for example, the male portion 14*a*2 and/or the female portion 14*b*2 illustrated in FIG. 4. The weak engagement portion may be disposed only in the first fitting tool 14, only in the second fitting tool 24, or disposed in both the first fitting tool 14 and the second fitting tool 24. Furthermore, when the weak engagement portion is disposed in the first fitting tool 14, the weak engagement portion may be disposed only in a portion adjacent to the left adhesive seal 13A, disposed only in a portion adjacent to the right adhesive seal 13B, or disposed in both a portion adjacent to the left adhesive seal 13A and a portion adjacent to the right adhesive seal 13B. When the weak engagement portion is disposed in the second fitting tool 24, the weak engagement portion may be disposed only in a portion adjacent to the left adhesive seal 13A, disposed only in a portion adjacent to the right adhesive seal 13B, or disposed in both a portion adjacent to the left adhesive seal 13A and a portion adjacent to the right adhesive seal 13B. When the weak engagement portion is disposed at only one location, print is preferably applied to promote understanding on the upper, lower, left, and right sides of the outer bag 10C. A length of the weak engagement portion is not particularly limited, but for example, is preferably 1/10 to 1/100 of a length in the longitudinal direction of the first fitting tool 14 and the second fitting tool 24. The length of the weak engagement portion is preferably, for example, 10 to 50 mm. Furthermore, the weak engagement portion may be disposed at the end of the first fitting tool 14 or the second fitting tool 24, or may be disposed at a position spaced a predetermined distance from the end of the first fitting tool 14 or the second fitting tool 24. The predetermined distance here is preferably, for example, more than 0 mm and 30 mm or less. As a specific example, the weak engagement portion is disposed at a length of 50 mm from a position 30 mm away from the end of the first fitting tool 14 or the end of the second fitting tool 24.

In the product-containing outer bag 300 according to the present embodiment, with the proviso that a distance between an edge of the first side 11 and the thick portion 4 (14) is d1, and a distance between an edge of the second side 12 and the second fitting tool 24 is d2, it is preferable to satisfy a relationship of $d1<d2$. By making d2 longer, the base material between the edge of the second side 12 and the second fitting tool 24 is easily sucked by a sucker disposed in the bag feeding device, and the second opening 7 is more easily opened.

In the product-containing outer bag 300 of the third example, the second fitting tool 24 is disposed in the second opening 7 serving as an outlet of the plurality of bags 3. Since the adhesive seal 13 is also disposed over the second fitting tool 24, at an intersection between the adhesive seal 13 and the second fitting tool 24, a resin lump due to heat melting of the male member 14*a* and the female member 14*b* may occur, so that upon taking out the plurality of bags 3 from a side of the second side 12 of the outer bag 10C by the bag feeding device, the bags 3 are likely to be caught at the intersection between the adhesive seal 13 and the second fitting tool 24. Therefore, by providing the auxiliary seal 15, the bags are disposed away from the adhesive seal 13, so that it is possible to prevent the bags 3 from being caught and to feed the bags without disturbing the alignment state. The auxiliary seal 15 is preferably provided closer to the first side 11 than the second fitting tool 24. It is possible to prevent the bags 3 from being caught at the intersection of the adhesive seal 13 and the second fitting tool 24.

In the product-containing outer bag 300 of the third example, the peripheral portion of the first side 11 is a portion clamped by the clamping arm of the bag feeding device, and the second side 12 is a take-out port of the plurality of bags 3 in the step of supplying the bags to the bag feeding device. Alternatively, the peripheral portion of the second side 12 may be a portion clamped by the clamping arm of the bag feeding device, and the first side 11 may be a take-out port of the plurality of bags 3 in the step of supplying bags to the bag feeding device. As described above, the product-containing outer bag 300 of the third example can be used without limitation on the upper and lower sides. When not limited to the upper and lower sides, the region S, on which the auxiliary seal 15 is disposed, is preferably a portion, of the adhesive seal 13, at a predetermined interval h1 from the edge of the second side 12 and a portion, of the adhesive seal 13, at a predetermined interval h2 from the edge of the first side 11. Furthermore, the weak engagement portion is preferably disposed at four corners, specifically, at a portion, of the first fitting tool 14, adjacent to the left adhesive seal 13A, a portion, of the first fitting tool 14, adjacent to the right adhesive seal 13B, a portion, of the second fitting tool 24, adjacent to the left adhesive seal 13A, and a portion, of the second fitting tool 24, adjacent to the right adhesive seal 13B. On the other hand, when it is desired to use the outer bag 10C by limiting the upper and lower sides, it is preferable to perform printing so that the upper, lower, left, and right sides of the outer bag 100 can be perceived.

Figure 11:
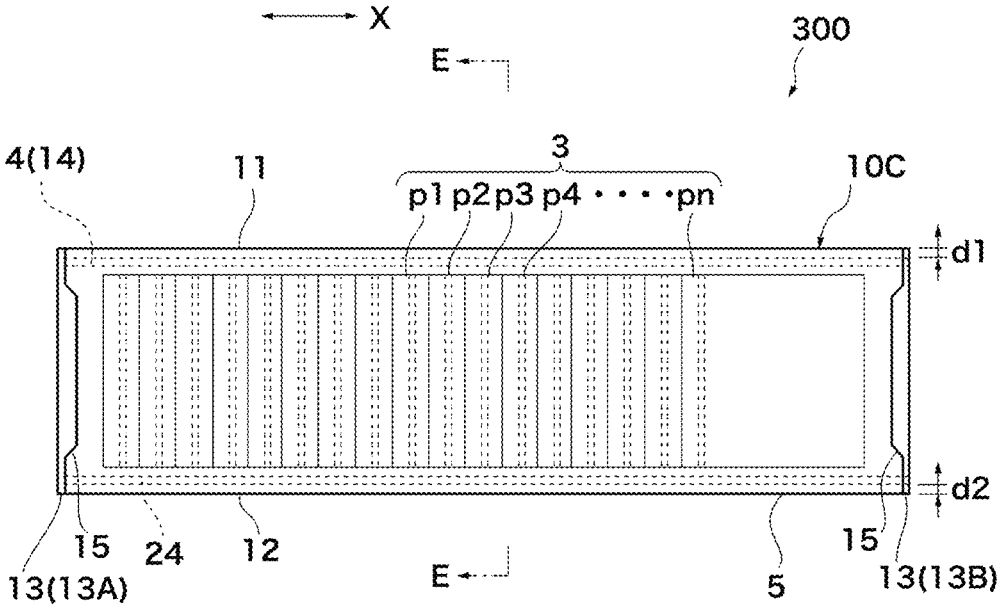
FIG. 11 is a front schematic view illustrating a third example of the product-containing outer bag according to the present embodiment.

In FIGS. 11 and 12, the thick portion 4 is the first fitting tool 14, but the thick portion 4 may be a rib or a ridge (not illustrated).

In the product-containing outer bag 300 of the third example, the held portion is a peripheral portion of the first side 11 or a peripheral portion of the second side 12. The peripheral portion of the first side 11 is a portion, having a predetermined width from the first side 11, of the first surface and the second surface. The peripheral portion of the second side 12 is a portion, having a predetermined width from the second side 12, of the first surface and the second surface. For example, the bag feeding device clamps the peripheral portion of the first side 11 or the peripheral portion of the second side 12 by a clamping arm or sucks the peripheral portion by a suction arm, whereby the product-containing outer bag 300 is supported in a suspended state.

In the product-containing outer bags 100, 200, and 300 of the first example, the second example, and the third example, each of the outer bags 10A, 10B, and 10C preferably include a portion where the inner walls of the base material 5 are in contact with each other. The position of the bags is fixed in the outer bags 10A, 10B, and 10C, and occurrence of an error in supply can be prevented in the bag feeding process. The state in which the inner walls of the base material 5 include the portion being in contact with each other is, for example, a state in which the air in the outer bags 10A, 10B, and 10C is degassed. With such a state, the cross sections of the outer bags 10A, 10B, and 10C are flattened, and the contact state with each inner wall of the outer bags 10A, 10B, and 10C and the bags 3 and the contact state between the bags 3 are less likely to deviate even during transportation. Therefore, upon taking out the bags 3, the state in which the bags 3 are packed can reappear as it is. Here, the state in which the cross section is flat refers to a state in which the flat surfaces of the plurality of bags 3 incorporated in the product-containing outer bags 100, 200, and 300 and the inner wall surface of the base material 5 are in contact with each other, and the cross section has an elongated shape reflecting the cross-sectional shape of the plurality of bags 3.

Modification examples of the product-containing outer bags 100 and 200 of the first example and the second example will be described. In the product-containing outer bags 100 and 200 of the first example and the second example, the outer bags 10A and 10B encompass a form having a second opening (not illustrated) opened along an edge of the second side 12 and an easy peel seal sealing the second opening. In the product-containing outer bag 100 of the first example, the second opening is, for example, a portion obtained by cutting a portion, where one base material 5 is folded, along the second side in the second side 12 illustrated in FIG. 2. In the product-containing outer bag 200 of the second example, the second opening is, for example, a portion obtained by cutting a portion, where one base material 5 is folded, along the second side in the second side 12 as illustrated in FIG. 10, or is an opening between ends of two base materials on the second side with the proviso that base material 5 has two base materials overlapped with each other. In the present specification, the easy peel seal refers to a seal having easy opening. A method of forming an easy peel seal is not particularly limited, and is, for example, a method of heat-sealing inner surfaces of the base material 5 to each other at a relatively low temperature, a method of forming a sealant film, constituting the inner surface of the base material 5, as an easy peel film, or a method of coating the inner surface of the base material with a resin having an easy peel property. By providing the easy peel seal in the second opening, the second opening can be more easily opened at the time of bag feeding.

In the product-containing outer bags 100 and 200 of the first example and the second example, the adhesive seal 13 (13A, 13B) includes a form of an easy peel seal. The easy peel seal in the adhesive seal 13 (13A, 13B) has the same configuration as the easy peel seal in the second opening. By forming the adhesive seal 13 (13A, 13B) as an easy peel seal in addition to the easy peel seal of the second opening, the second opening can be opened at the time of bag feeding, and the adhesive seal 13 (13A, 13B) can be peeled off to open the three sides of the outer bags 10A and 10B. As a result, the bags 3 can be taken out more stably.

Furthermore, in the product-containing outer bags 100 and 200 of the first example and the second example, the outer bags 10A and 10B include a form having a perforation (not illustrated) along the edge of the second side 12. The perforation is an intermittent slit formed in the base material 5. The slit may be linear or dotted. The perforation may be disposed on the edge of the second side 12 or at a position shifted from the edge of the second side 12. The form in which the perforation is disposed at a position deviated from the edge of the second side 12 is a form in which the perforation is disposed at a freely selected position on a side closer to the first side 11 than the edge of the second side 12 of the first surface and the second surface of the base material 5. As a result, the lower side of the perforation of the outer bags 10A and 10B can be separated, and the lower ends of the outer bags 10A and 10B are opened. As a result, the bags 3 can be taken out more stably.

When the outer bags 10A and 10B have perforations along the edge of the second side 12, it is preferable that the outer bags 10A and 10B each have the thick portion 4, as a held portion, and perforations parallel to the thick portion 4, as illustrated in FIGS. 2 and 10, and the perforations are disposed at freely selected positions on the side closer to the first side 11 than the edge of the second side 12 of the first surface and the second surface of the base material 5. For example, when the outer bags 10A and 10B are hung down by engaging the clamping arm with the thick portion 4, a tensile force in an upward direction acts on the portion of the base material 5 where the thick portion 4 is disposed. In this state, when a tensile force in a downward direction is applied to the perforation, stress concentrates on the perforation, so that the lower side of the perforation of the outer bags 10A and 10B can be more easily separated.

A modification example of the product-containing outer bag 300 of the third example will be described. In the product-containing outer bag 300 of the third example, the outer bag 10C encompasses a form having a perforation extending in parallel with the first fitting tool 14 and on the side closer to the second side 12 than the first fitting tool 14 or a perforation extending in parallel with the second fitting tool 24 and on the side closer to the first side 11 than the second fitting tool 24. The perforation is an intermittent slit formed in the base material 5. The slit may be linear or dotted. When the outer bag 10C has a perforation extending in parallel with the first fitting tool 14 and on the side closer to the second side 12 than the first fitting tool 14, the perforation is preferably disposed at a freely selected position on the side closer to the first side 11 than the edge of the second side 12 of the first surface and the second surface of the base material 5. Furthermore, when the outer bag 10C has a perforation extending in parallel with the second fitting tool 24 and on the side closer to the first side 11 than the second fitting tool 24, the perforation is preferably provided at a freely selected position, on the first surface and the second surface of the base material 5, on the side closer to the second side 12 than the edge of the first side 11. A form where the outer bag 10C has a perforation extending in parallel with the first fitting tool 14 and on the side closer to the second side 12 than the first fitting tool 14 will be described as an example. When the clamping arm is engaged with the first fitting tool 14 and the outer bag 10C is hung down, a tensile force in the upward direction acts on the portion of the base material 5 where the first fitting tool 14 is provided. In this state, when a tensile force in the downward direction is applied to the perforation, stress concentrates on the perforation, so that the lower side of the perforation of the outer bag 10C can be more easily separated, and the lower end of the outer bag 10C is opened. As a result, the bags 3 can be taken out more stably.

(Method of Manufacturing Product-Containing Outer Bag)

Figure 13:
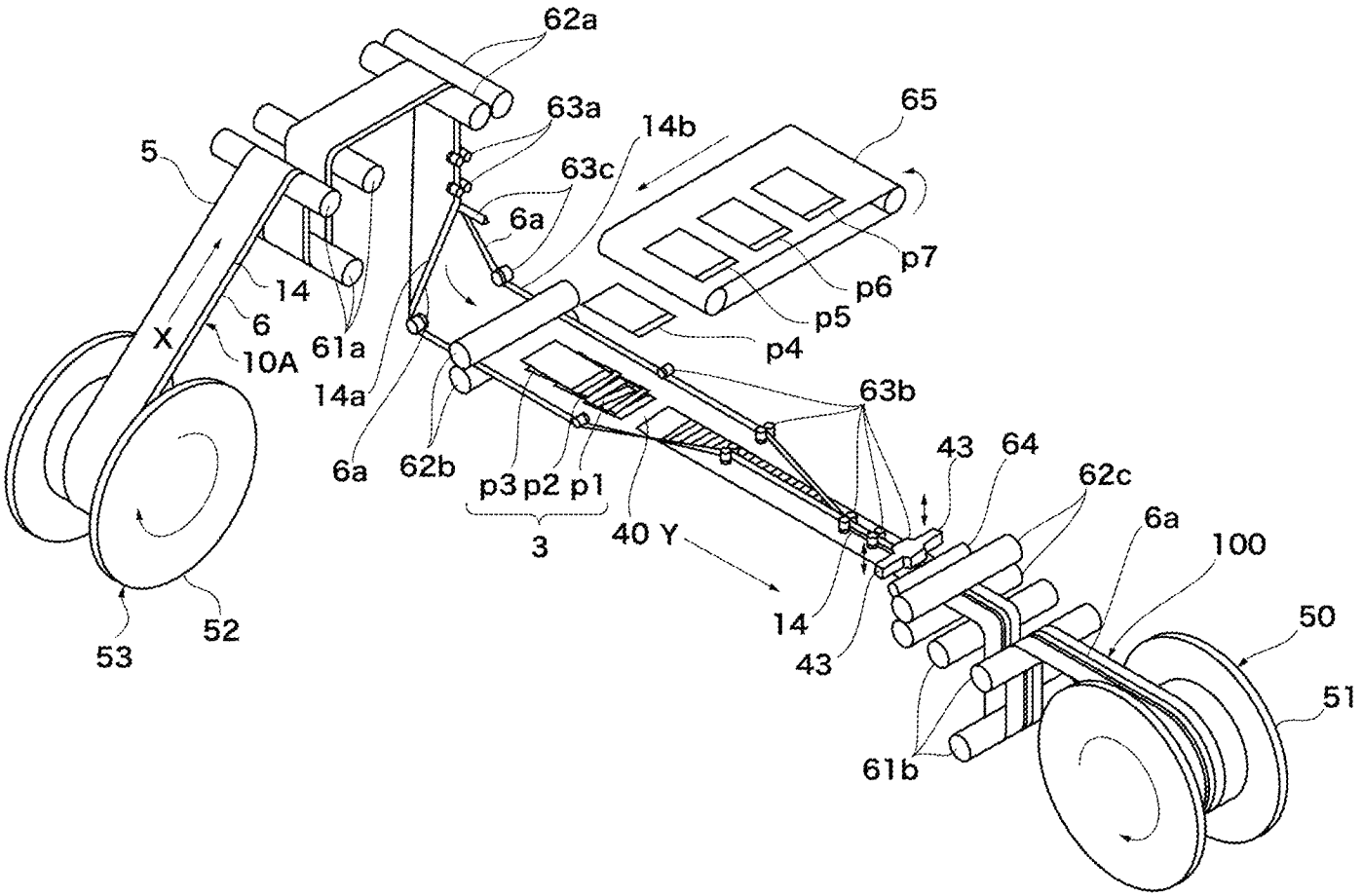
FIG. 13 is a schematic view for explaining a first method of manufacturing the product-containing outer bag according to the present embodiment, and is a view illustrating a form in which the product-containing outer bag is the product-containing outer bag illustrated in FIG. 1.

Next, a method of manufacturing the product-containing outer bag according to the present embodiment will be described with reference to FIG. 13. A method of manufacturing a product-containing outer bag according to the present embodiment is a method of manufacturing a product-containing outer bag in which a plurality of bags 3 stacked in a row continuously or intermittently, with the bags (p1, p2, p3, p4, . . . , pn) as products partially overlapping each other, are wrapped and integrated with an outer bag 10A, for outer packaging, such that a state of stacking the bags 3 is maintained, in which the outer bag 10A has a tubular shape continuously extending with the same inner diameter along a length direction X of a cylinder having a resin film as a base material 5, including at least one opening 6 opening along the length direction X of the cylinder, and a fitting tool 14 as a thick portion on an inner wall side of the base material 5 along an edge 6*a* of the opening, and the opening 6 has a structure to be closed by engaging the fitting tool 14, and in which the method includes: a first step of preparing the outer bag 10A; a second step of making the outer bag 10A released from the engagement of the fitting tool 14 and opened; a third step of, on the base material 5, stacking the bags in a row continuously or intermittently along a longitudinal direction Y of the base material 5 such that the bags (p1, p2, p3, p4, . . . , pn) partially overlap each other, and providing non-arrangement portions 40, having no disposed bags, at intervals of a period for stacking a predetermined number of bags on predetermined spacing; a fourth step of wrapping the plurality of bags 3 with the base material 5 while moving the base material 5 on which the plurality of bags 3 is placed in the longitudinal direction Y of the base material 5, and engaging the fitting tool 14 to obtain the product-containing outer bag 100; and a fifth step of disposing an adhesive seal 13 (illustrated in FIG. 1) and an auxiliary seal 15 (illustrated in FIG. 1) at locations corresponding to the non-arrangement portions 40 with respect to the product-containing outer bag 100. Note that, in FIG. 13, the adhesive seal 13 and the auxiliary seal 15 are not illustrated.

(First Manufacturing Method)

In a first manufacturing method, an outer bag for outer packaging and a product-containing outer bag are the outer bag 10A and the product-containing outer bag 100 illustrated in FIGS. 1 to 5, and a bag is the bag p1 illustrated in FIGS. 6 and 7. Furthermore, the product-containing outer bag 100 may be wound around a bobbin 51. Moreover, the length direction X of the cylinder and the longitudinal direction Y of the base material 5 are the same as the alignment direction X of the plurality of bags 3.

(First Step)

An outer bag-wound product 53 of the outer bag 10A for outer packaging wound around a bobbin 52 is prepared. The outer bag 10A for outer packaging is wound around the bobbin 52 in a flat state in which the fitting tool 14 is engaged and the cylinder is squashed so that the fitting tool 14 is located at the side end. The outer bag 10A for outer packaging is unwound in the length direction X of the cylinder and fed to a dance roll 61*a* and a pinch roll 62*a*. Furthermore, when the fitting tool 14 is separate from the base material 5, the first step includes a step 1A of preparing a cylindrical film or a half-cut film to which the fitting tool 14 is not bonded, and a step 1B of attaching a fitting tool tape to the cylindrical film or the half-cut film.

(Second Step)

It is assumed that the outer bag 10A for outer packaging is released from the engagement of the fitting tool 14 and is opened. That is, after passing the outer packaging outer bag 10A through the pinch roll 62*a*, the engagement of the fitting tool 14 is released by a claw guide roll 63*c*, the outer bag 10A for outer packaging is opened and is sent to the pinch roll 62*b* in a state where the overlapping of the base materials 5 is eliminated.

(Third Step)

The base material 5 is formed into a flat sheet shape, and the bags (p1, p2, p3, p4, . . . , pn) are placed thereon.

Specifically, the outer bag 10A for outer packaging is opened, in a state where the base material 5 does not overlap, and the bags are stacked in a row continuously or intermittently along the longitudinal direction Y of the base material 5 such that the bags (p1, p2, p3, p4, . . . , pn) partially overlap on the base material 5. At this time, it is preferable that the plurality of bags 3 are stacked in a row, with their ends shifted from each other, along the longitudinal direction Y of the base material 5. Then, at intervals of a period for stacking a predetermined number of bags on predetermined spacing, the non-arrangement portions 40 having no disposed bags are provided. FIG. 13 illustrates a mode in which the bags (p1, p2, p3, $p^4$, . . . , pn) are continuously stacked in a line, and the non-arrangement portions 40, having no disposed bags, are provided at intervals of a period for stacking a predetermined number of bags on predetermined spacing. Here, the bags (p1, p2, p3, p4, . . . , pn) are placed one by one on a conveyance conveyor 65 positioned on a downstream side of a bag making machine (not illustrated) and sent. Bags on the conveyance conveyor 65, for example, the bags p4, p5, p6, and p7 are sequentially placed on the base material 5.

(Fourth Step)

While the base material 5 on which the plurality of bags 3 is placed is moved in the longitudinal direction Y of the base material 5, the plurality of bags 3 are wrapped with the base material 5 by the claw guide roll 63*b*, and the fitting tool 14 is engaged to obtain the product-containing outer bag 100. It is preferable that the product-containing outer bag 100, with which the fitting tool 14 is engaged, is sent to the touch roll 64, the pinch roll 62*c*, and the dance roll 61*b* with the opening 6 laid down horizontally near the root of the fitting tool 14. The inside of the product-containing outer bag 100 is degassed, and the volume is reduced.

(Fifth Step)

The adhesive seal 13 (illustrated in FIG. 1) and the auxiliary seal 15 (illustrated in FIG. 1) are disposed at positions corresponding to the non-arrangement portions 40 with respect to the product-containing outer bag 100. The adhesive seal 13 and the auxiliary seal 15 are preferably formed by thermally welding the inner wall surfaces of the opposing base materials to each other with, for example, a heat sealer 43 pressed against positions corresponding to the non-arrangement portions 40. The adhesive seal 13 and the auxiliary seal 15 are obtained by thermally welding the opposing base materials to each other and by forming a thermally welded portion, using the heat sealer whose temperature is kept in a temperature range not to cause cutout. Alternatively, the adhesive seal 13 and the auxiliary seal 15 may be formed by bonding the inner wall surfaces of the opposing base materials to each other. Although FIG. 13 illustrates a mode in which the auxiliary seal 15 is provided simultaneously with the adhesive seal 13, the auxiliary seal may be provided in another process after the adhesive seal 13 is provided, or may be provided in another process before the adhesive seal 13 is provided.

(Winding Step)

The product-containing outer bag 100 may be wound around the bobbin 51, in a state where the cross section is flat, to obtain a wound product 50 of the product-containing outer bag. Although FIG. 13 illustrates the form of a wound roll, the form of the product-containing outer bag 100 may be a hank or zigzag in a state where the cross section is flat. When the product-containing outer bag 100 is folded in zigzag, it is preferable to fold the outer bag in accordance with a position of the adhesive seal 13.

(Cutting Step)

The wound product 50 of the product-containing outer bag is cut at a position, where the adhesive seal 13 is disposed, to obtain the product-containing outer bag 100. The cutting step may be performed after the winding step, or may be performed without performing the winding step after the fifth step. It is preferable that the obtained product-containing outer bag 100 is sucked to be automatically packed in a predetermined number, by, for example, a suction arm. In this manner, the product-containing outer bag 100 can automatically perform from bag making to boxing.

In the first manufacturing method, the outer bag 10A includes one fitting tool 14, and in the second step, the base material 5 is horizontally unfolded, and in the fourth step, the fitting tool 14 is disposed on the stacking surface of the bags 3 and further engaged. According to the first manufacturing method, the bags 3 can be easily wrapped in the outer bag 10A in the form of butt seaming, and the fitting tool 14 can be easily engaged. Therefore, it is easy to manufacture with a device having a simple structure.

(Second Manufacturing Method)

Figure 14:
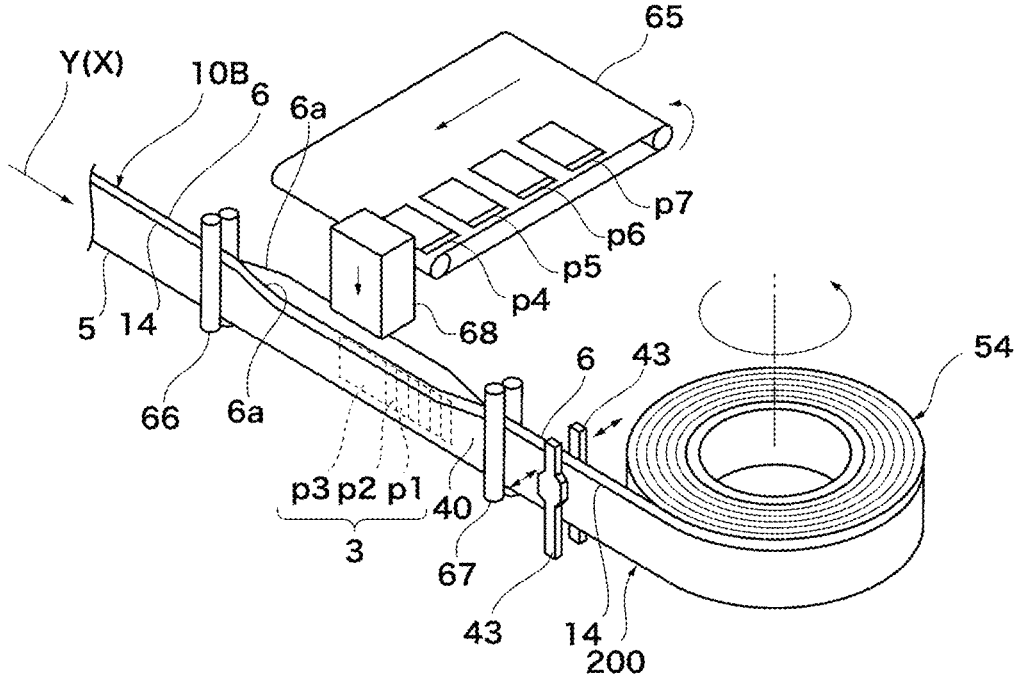
FIG. 14 is a schematic view for explaining a second method of manufacturing the product-containing outer bag according to the present embodiment, and is a view illustrating a form in which the product-containing outer bag is the product-containing outer bag illustrated in FIG. 9.

Next, a second method of manufacturing the product-containing outer bag according to the present embodiment will be described with reference to FIG. 14. Here, an outer bag for outer packaging and a product-containing outer bag are the outer bag 10B and the product-containing outer bag 200 illustrated in FIGS. 9 and 10, and a bag is the bag p1 illustrated in FIGS. 6 and 7. Furthermore, the product-containing outer bag 200 may be wound around the bobbin 51 (In FIG. 14, the drawing of the bobbin is omitted). Moreover, the length direction X of the cylinder and the longitudinal direction Y of the base material 5 are the same as the alignment direction X of the plurality of bags 3.

(First Step)

This step is similar to that of the first manufacturing method. In FIG. 14, illustration of the first step is omitted. Furthermore, when the fitting tool 14 is separate from the base material 5, the first step includes a step 1A of preparing a cylindrical film or a half-cut film to which the fitting tool 14 is not bonded, and a step 1B of attaching a fitting tool tape to the cylindrical film or the half-cut film.

(Second Step)

After passing the outer bag 10B for outer packaging through a claw opening 66, the base material 5 is unfolded so that the cross section of the base material 5 in the longitudinal direction Y has a U shape or a V shape, and the engagement of the fitting tool 14 is released and the outer bag 10B is in a state of being opened.

(Third Step)

It is preferable to put the bags inside the U-shaped or V-shaped base material with one of sides of the left and right side ends of the bags facing downward. Since the bags are capable of being aligned finely by gravity, the bags are aligned more neatly in the product-containing outer bag. That is, the outer bag 10B is opened, and the bags are stacked in a row continuously or intermittently inside the U-shaped or V-shaped base material 5 along the longitudinal direction Y of the base material 5 such that the bags (p1, p2, p3, p4, . . . , pn) partially overlap each other by an alignment device 68. Then, at intervals of a period for stacking a predetermined number of bags on predetermined spacing, the non-arrangement portions 40, having no disposed bags, are provided. FIG. 14 illustrates a mode in which the bags (p1, p2, p3, p4, . . . , pn) are continuously stacked in a line, and the non-arrangement portions 40, having no disposed bags, are provided at intervals of a period for stacking a predetermined number of bags on predetermined spacing.

Here, the bags (p1, p2, p3, p4, . . . , pn) are placed one by one on a conveyance conveyor 65 positioned on a downstream side of a bag making machine (not illustrated) and sent. The bags on the conveyance conveyor 65, for example, the bags p4, p5, p6, and p7 are sequentially put inside the base material 5.

(Fourth Step)

While moving the base material 5 in which the plurality of bags 3 are put inside in the longitudinal direction Y of the base material 5, the plurality of bags 3 are wrapped with the base material 5 by a claw hook 67 and the fitting tool 14 is engaged to obtain the product-containing outer bag 200. In the product-containing outer bag 200 in which the fitting tool 14 is engaged, the inside of the product-containing outer bag 200 is degassed, and the volume decreases.

(Fifth Step)

The adhesive seal 13 (illustrated in FIG. 1) and the auxiliary seal 15 (illustrated in FIG. 1) are disposed at positions corresponding to the non-arrangement portions 40 with respect to the product-containing outer bag 200. The adhesive seal 13 and the auxiliary seal 15 are preferably formed by thermally welding the inner wall surfaces of the opposing base materials to each other with, for example, a heat sealer 43 pressed against positions corresponding to the non-arrangement portions 40. Alternatively, the adhesive seal 13 and the auxiliary seal 15 may be formed by bonding the inner wall surfaces of the opposing base materials to each other. Although FIG. 14 illustrates a mode in which the auxiliary seal 15 is provided simultaneously with the adhesive seal 13, the auxiliary seal may be provided in another process after the adhesive seal 13 is provided, or may be provided in another process before the adhesive seal 13 is provided.

(Winding Step)

The product-containing outer bag 200 may be wound around the bobbin 51, in a state where the cross section is flat, to obtain a wound product 54 of the product-containing outer bag. Although FIG. 14 illustrates the form of a wound roll, the form of the product-containing outer bag 200 may be a hank or zigzag in a state where the cross section is flat. When the product-containing outer bag 200 is folded in zigzag, it is preferable to fold the outer bag in accordance with a position of the adhesive seal 13.

(Cutting Step)

The wound product 54 of the product-containing outer bag is cut at a position, where the adhesive seal 13 is disposed, to obtain the product-containing outer bag 200. The cutting step may be performed after the winding step, or may be performed without performing the winding step after the fifth step. It is preferable that the obtained product-containing outer bag 200 is sucked to be automatically packed in a predetermined number, by, for example, a suction arm. In this manner, the product-containing outer bag 200 can automatically perform from bag making to boxing.

(Third Manufacturing Method)

Figure 15:
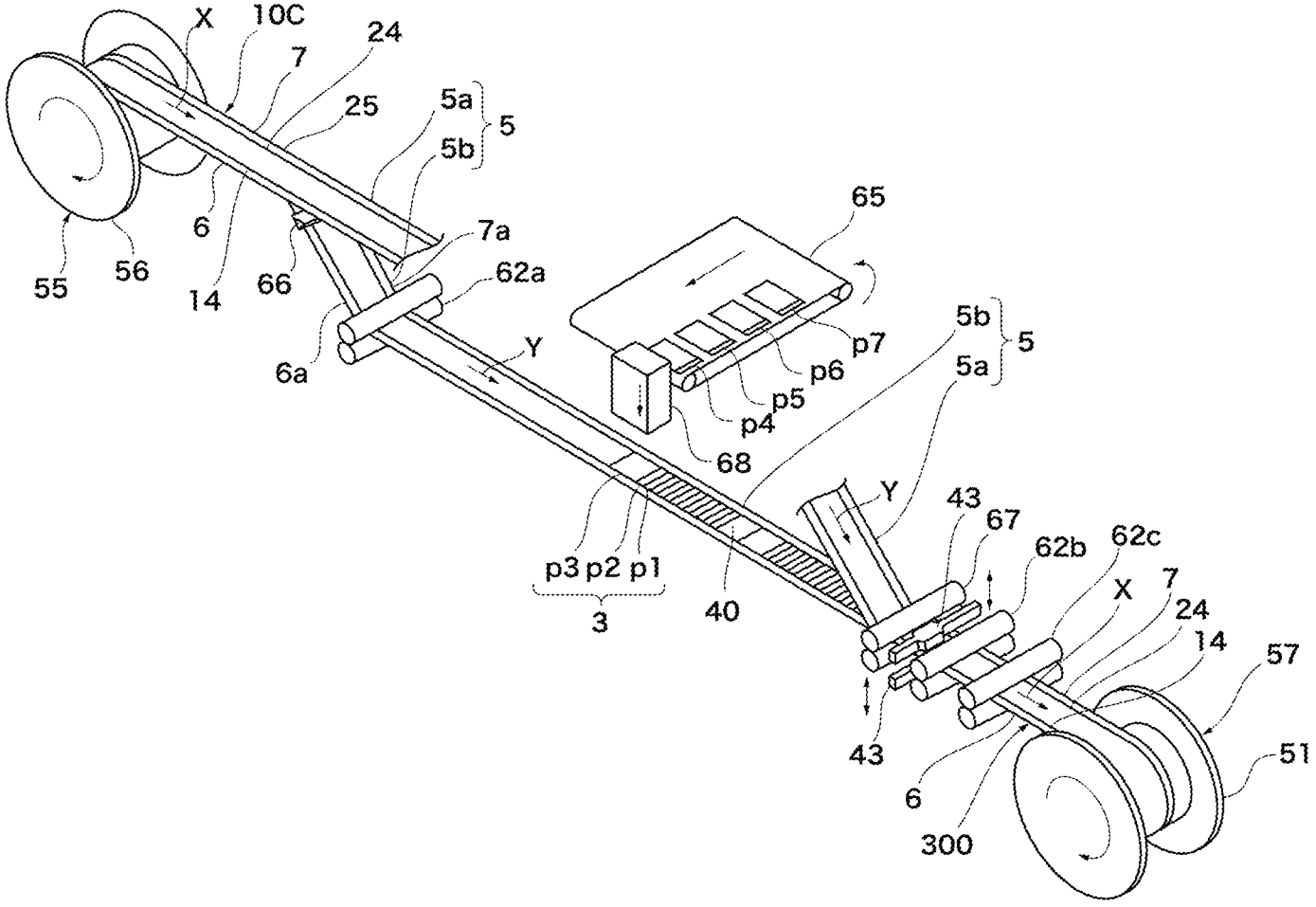
FIG. 15 is a schematic view for explaining a third method of manufacturing the product-containing outer bag according to the present embodiment, and is a view illustrating a form in which the product-containing outer bag is the product-containing outer bag illustrated in FIG. 11.

Next, a third method of manufacturing a wound product of the product-containing outer bag according to the present embodiment will be described with reference to FIG. 15. Here, an outer bag for outer packaging and a product-containing outer bag are the outer bag 10C and the product-containing outer bag 300 illustrated in FIGS. 11 and 12, and a bag is the bag p1 illustrated in FIGS. 6 and 7. The product-containing outer bag 300 may be wound around the bobbin 51. Moreover, the length direction X of the cylinder and the longitudinal direction Y of the base material 5 are the same as the alignment direction X of the plurality of bags 3.

(First Step)

An outer bag-wound product 55 of the outer bag 10C for outer packaging wound around a bobbin 56 is prepared. The outer bag 10C for outer packaging has two fitting tools, i.e., the fitting tools 14 and 24 that are engaged, and is wound around the bobbin 56 in a flat state in which the cylinders is squashed so that the fitting tools 14 and 24 are located at both side ends. The outer bag 10C for outer packaging is fed out in the length direction X of the cylinder and sent out to the claw opening 66. Furthermore, when the fitting tools 14 and 24 are separate from the base material 5, the first step includes a step 1A of preparing a cylindrical film or a half-cut film to which the fitting tools 14 and 24 are not bonded, and a step 1B of attaching a fitting tool tape to the cylindrical film or the half-cut film.

(Second Step)

After the outer bag 10C for outer packaging passes through the claw opening 66 and is released from the engagement of the fitting tools 14 and 24, one base material 5*b* of two-divided materials from the base material 5 is made to branch out horizontally, and the other base material 5*a* of the materials is made to branch out, horizontally, above the base material 5*b*. The base material 5*b* is fed to the pinch roll 62*a*. The base material 5*a* is also fed to a pinch roll (not illustrated).

(Third Step)

It is preferable that the base material 5*b* has a flat sheet shape, and the bags are placed on the base material 5*b* such that the fitting tools 14 and 24 located on both end sides, in a width direction of the base material 5*b*, are located on a side of the left side end and on a side of the right side end of the bags (p1, p2, p3, p4, . . . , pn), respectively. That is, the base material 5*b* is unfolded, and the bags (p1, p2, p3, p4, . . . , pn) are stacked in a row continuously or intermittently along the longitudinal direction Y by the alignment device 68 such that the bags are partially overlapped. Then, at intervals of a period for stacking a predetermined number of bags on predetermined spacing, the non-arrangement portions 40, having no disposed bags, are provided. FIG. 15 illustrates a mode in which the bags (p1, p2, p3, p4, . . . , pn) are continuously stacked in a line, and the non-arrangement portions 40, having no disposed bags, are provided at intervals of a period for stacking a predetermined number of bags on predetermined spacing. Here, the bags (p1, p2, p3, p4, . . . , pn) are placed one by one on a conveyance conveyor 65 positioned on a downstream side of a bag making machine (not illustrated) and sent. The bags on the conveyance conveyor 65, for example, the bags p4, p5, p6, and p7 are sequentially placed on one base material 5*b*.

(Fourth Step)

It is preferable that the fitting tools 14 and 24 are engaged by the claw hook 67 such that the bags 3 are moved in the longitudinal direction Y, with the plurality of bags 3 placed on the one base material 5*b*, and covered with the one base material 5*b* that has been simultaneously moved in the longitudinal direction Y. The product-containing outer bag 300 is obtained by the engagement of the fitting tools 14 and 24. Upon passing, through the pinch rolls 62*b* and 62*c*, the product-containing outer bag 300 in which the fitting tools 14 and 24 are engaged, the inside of the product-containing outer bag 300 is degassed, and the volume decreases. The bags 3 can be put into the outer bag 10C by a simple operation of dividing the outer bag 10C for outer packaging into upper and lower portions as one base material 5*b* and the other base material 5*a*, disposing the bags 3 therebetween, and closing the portions to the original state.

(Fifth Step)

The adhesive seal 13 (illustrated in FIG. 1) and the auxiliary seal 15 (illustrated in FIG. 1) are disposed at position corresponding to the non-arrangement portions 40 with respect to the product-containing outer bag 300. The adhesive seal 13 and the auxiliary seal 15 are preferably formed by thermally welding the inner wall surfaces of the opposing base materials to each other with, for example, a heat sealer 43 pressed against positions corresponding to the non-arrangement portions 40. Alternatively, the adhesive seal 13 and the auxiliary seal 15 may be formed by bonding the inner wall surfaces of the opposing base materials to each other.

(Winding Step)

The product-containing outer bag 300 may be wound around the bobbin 51, in a state where the cross section is flat, to obtain a wound product 57 of the product-containing outer bag. Although FIG. 15 illustrates the form of a wound roll, the form of the product-containing outer bag 300 may be a hank or zigzag in a state where the cross section is flat. When the product-containing outer bag 300 is folded in zigzag, it is preferable to fold the outer bag in accordance with a position of the adhesive seal 13.

(Cutting Step)

The wound product 57 of the product-containing outer bag is cut at a position, where the adhesive seal 13 is disposed, to obtain the product-containing outer bag 300. The cutting step may be performed after the winding step, or may be performed without performing the winding step after the fifth step. It is preferable that the obtained product-containing outer bag 300 is sucked to be automatically packed in a predetermined number by, for example, a suction arm. In this manner, the product-containing outer bag 200300 can automatically perform from bag making to boxing.

The first to third manufacturing methods preferably further include a decompression step of decompressing the inside of the outer bags 10A, 10B, and 10C. Each of the outer bags 10A, 10B, and 10C can have a portion where the inner walls of the base material 5 are in contact with each other, and the position of the bags is fixed in the outer bags 10A, 10B, and 10C, so that occurrence of an error in supply can be prevented in the bag feeding process. The decompression step is preferably performed, for example, by opening a part of the fitting tools of the product-containing outer bags 100, 200, and 300 in a continuous state before the cutting step, or the fitting tools 14 and 24 of the product-containing outer bags 100, 200, and 300 in a separated state obtained after the cutting step, for example, a weak engagement portion or other portions, inserting a deaerating nozzle into the opening, decompressing the inside of the outer bags 10A, 10B, and 10C, and then closing the opened engagement portion. Furthermore, the decompression step may be performed before the adhesive seal 13 is provided in the fifth step or at the same time as the adhesive seal 13 is provided. Even when the decompression step is performed in the fifth step, similarly to the example where the decompression step is performed before and after the cutting step, a part of the fitting tools 14 and 24 of the product-containing outer bags 100, 200, and 300, for example, a weak engagement portion or other portions is opened, and a deaerating nozzle is inserted into the opening to decompress the inside of the outer bags 10A, 10B, and 10C, and then the opened engagement portion is closed, whereby the inside of the outer bags 10A, 10B, and 10C can be decompressed.

(Bag Feeding Device)

Figure 16:
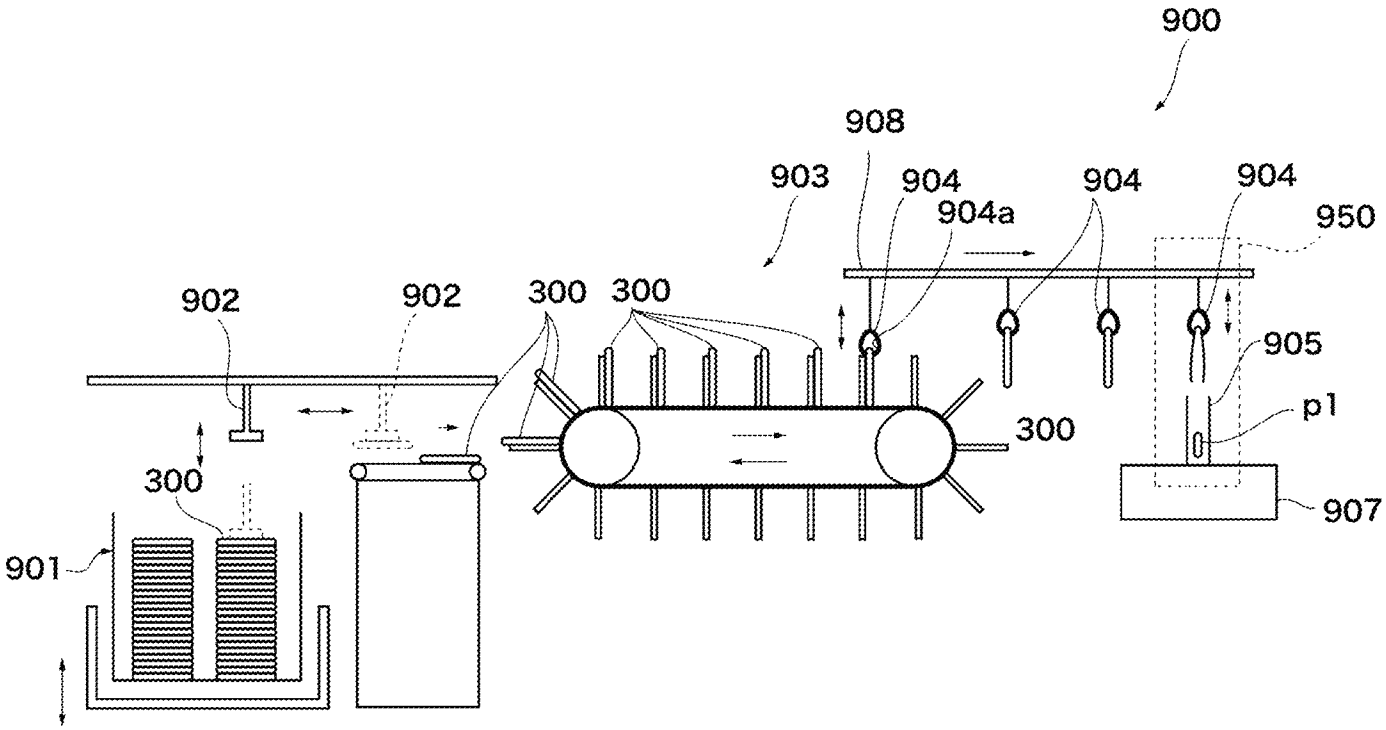
FIG. 16 is a schematic diagram illustrating a first example of a bag feeding device for explaining a supply method of bags, and is a diagram illustrating a form in which a product-containing outer bag is the product-containing outer bag illustrated in FIG. 11.
Figure 17:
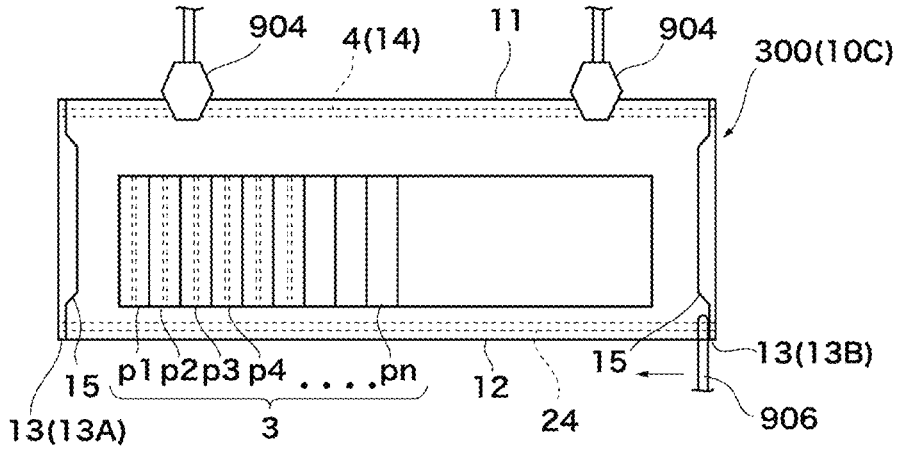
FIGS. 17(*a*) and 17(*b*) are partially enlarged views of a product-containing outer bag in a region 950 of FIG. 16 as viewed from the front, in which FIG. 17(*a*) illustrates a state before the outer bag is opened and FIG. 17(*b*) illustrates a state after the outer bag is opened.
Figure 17:
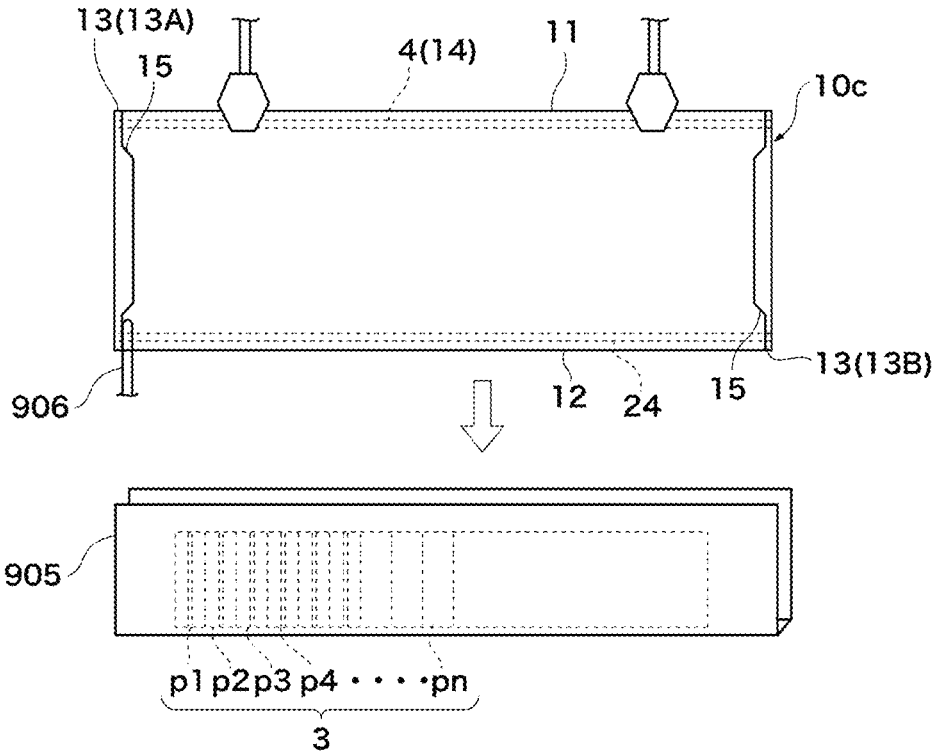
Figure 20:
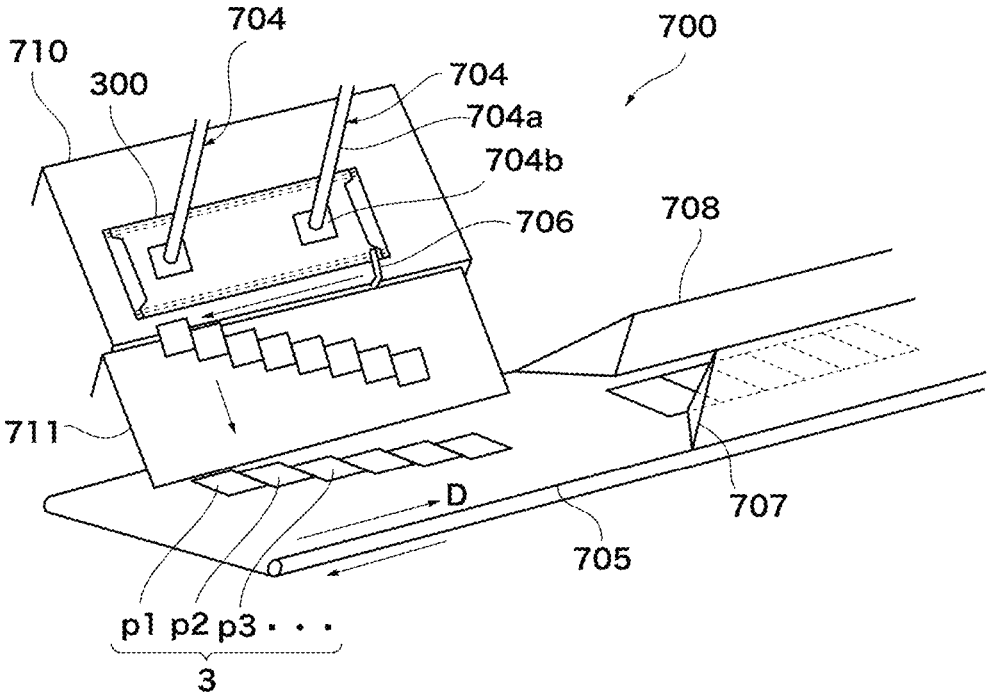
FIG. 20 is a partial schematic view illustrating a second example of the bag feeding device.

Next, a bag feeding device according to the present embodiment will be described with reference to FIGS. 16, 17, 20, and 21. Bag feeding devices 700, 800, and 900 according to the present embodiments are bag feeding devices each of which sequentially supplies, to a filling machine, a plurality of bags p1, p2, p3, p4, . . . , and pn, as products, incorporated in a product-containing outer bag 300 in which the plurality of bags 3 stacked in a row continuously or intermittently, with the bags p1, p2, p3, p4, . . . , and pn partially overlapping each other, are wrapped and integrated with an outer bag 10C, for outer packaging, having a resin film as a base material such that a state of stacking the bags is maintained, the bag feeding devices including: the holding instruments 704 and 904 supporting the product-containing outer bag 300 in a suspended state; opening instruments 706 and 906 that open a lower end of the product-containing outer bag 300 supported in a suspended state; receiving instruments 705 and 905 that receive the plurality of bags 3 coming out of the outer bag 10C; alignment instruments 707, 807, and 905 that align the plurality of bags 3; and supply instruments 705 and 907 that supply the aligned bags 3 to the filling machine. In FIGS. 16, 17, and 20, the form in which a product-containing outer bag is the product-containing outer bag 300 of the third example is illustrated as an example, but a product-containing outer bag may be the product-containing outer bag 100 of the first example (illustrated in FIG. 1) or the product-containing outer bag 200 of the second example (illustrated in FIG. 9).

Figure 21:
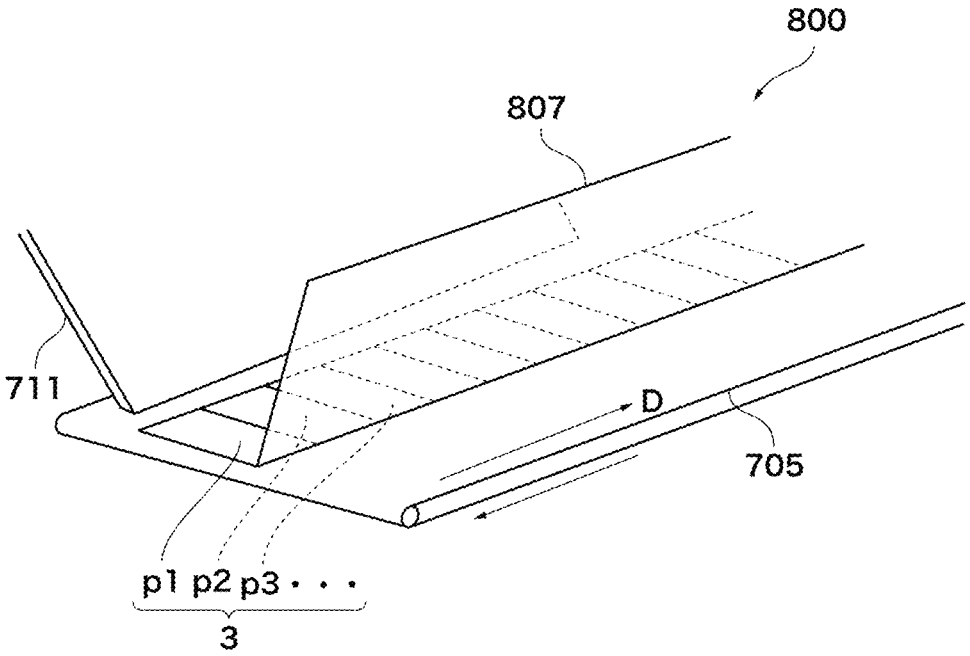
FIG. 21 is a partial schematic view illustrating a third example of the bag feeding device.

The bag feeding device according to the present embodiment includes the bag feeding device 900 of the first example illustrated in FIGS. 16 and 17, the bag feeding device 700 of the second example illustrated in FIG. 20, and the bag feeding device 800 of the third example illustrated in FIG. 21. Next, each example will be described.

Bag Feeding Device of First Example

In the bag feeding device 900 of the first example according to the present embodiment, the holding instrument 904 includes a form of a clamping arm. The clamping arm 904 preferably has engaging claws 904*a* at a pair of distal end portions. Furthermore, the clamping arm 904 may have a non-slip portion (not illustrated) for supporting the clamped product-containing outer bag 300 instead of the engaging claws 904*a*. The non-slip portion is a portion that increases friction provided on the inner portion of the distal end portion of the clamping arm 904, and for example, has a form in which an uneven structure is formed on the inner portion of the distal end portion of the clamping arm 904 or a form in which an anti-slip sheet is attached to the inner portion of the distal end portion of the clamping arm 904. FIG. 16 illustrates a mode in which the clamping arm 904 is hung on a circulating rail 908 and moves along the circulating rail 908 as an example, but the present disclosure is not limited thereto. For example, each of the clamping arms 904 may be attached to a robot main body (not illustrated) and moved by the robot main body. FIG. 17 illustrates, as an example, a mode in which one product-containing outer bag 300 is clamped by one set of two clamping arms 904, but the present disclosure is not limited thereto. According to a length of the product-containing outer bag 300, one product-containing outer bag 300 may be clamped by one clamping arm 904, or for example, one product-containing outer bag 300 may be clamped by one set of three clamping arms 904.

When the product-containing outer bag 300 has the fitting tool 24 on the second side 12 as illustrated in FIG. 17, the opening instrument 906 is preferably a rod-shaped jig for releasing the engagement by being inserted into the engagement portion of the fitting tool 24. Furthermore, as illustrated in FIG. 1 or 9, when the product-containing outer bags 100 and 200 do not have the fitting tool 24 on the second side 12, the opening instrument 906 may be a blade (not illustrated) or a suction instrument (not illustrated) that opens a fragile portion (not illustrated) provided on the second side 12. The suction instrument is sucked to the first surface and the second surface at the peripheral portion of the second side 12 to separate the first surface and the second surface, thereby opening the fragile portion.

In the product-containing outer bags 100 and 200 illustrated in FIG. 1 or 9, when the outer bags 10A and 10B have the second opening or the second opening and the adhesive seal 13 (13A, 13B) with an easy peel seal (not illustrated), the opening instrument 906 is preferably a suction instrument (not illustrated) that is sucked to the first surface and the second surface to separate the first surface and the second surface from each other.

In the product-containing outer bags 100 and 200 illustrated in FIG. 1 or 9, when the outer bags 10A and 10B have perforations parallel to the thick portion 4, the opening instrument 906 is preferably a pulling jig (not illustrated) including a chuck (not illustrated) that grips a portion below the perforations of the outer bags 10A and 10B and a lifting device (not illustrated) that lifts and lowers the chuck.

In the product-containing outer bag 300 illustrated in FIG. 17, when the outer bag 10C has a perforation extending, in parallel with the first fitting tool 14, on a side closer to the second side 12 side than the first fitting tool 14 or a perforation extending, in parallel with the second fitting tool 24, on a side closer to the first side 11 side than the second fitting tool 24, the opening instrument 906 is preferably a pulling jig (not illustrated) having a chuck (not illustrated) for picking a lower portion of the outer bag 10C than the perforation and a lifting device (not illustrated) for lifting and lowering the chuck.

In the bag feeding device 900 of the first example according to the present embodiment, the receiving instrument is a guide rail 905 that holds and transfers the plurality of bags 3 in a standing state, and the guide rail 905 also serves as the alignment instrument. The guide rail 905 is, for example, a groove-shaped member whose upper surface is opened.

The supply instrument 907 is, for example, a belt conveyor.

Figure 18:
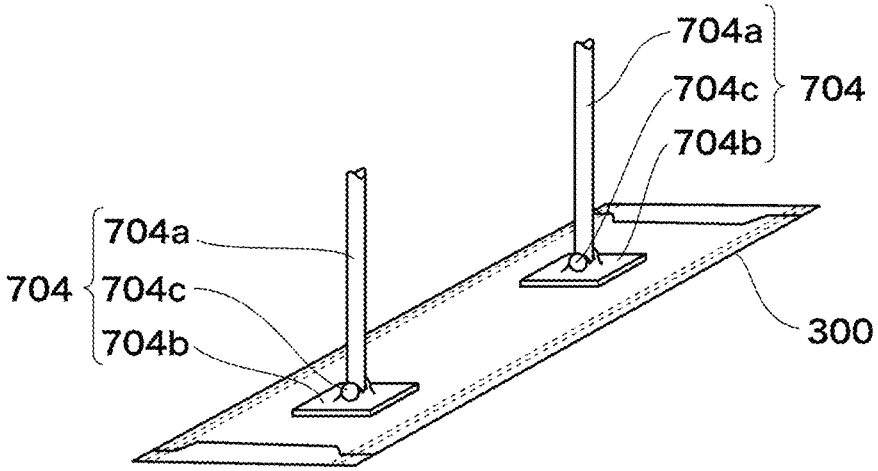
FIG. 18 illustrates a modification example of the bag feeding device in which a holding instrument is a suction arm.

FIG. 18 is a modification example of the bag feeding device of the first example, and illustrates a mode in which the holding instrument is a suction arm. The bag feeding device 900 of the first example illustrated in FIGS. 16 and 17 may include a suction arm 704, instead of the clamping arm 904, as the holding instrument. The suction arm 704 includes an arm portion 704*a* and a suction portion 704*b* provided at a distal end portion of the arm portion 704*a*. The suction portion 704*b* is preferably a vacuum pad that sucks an object to be sucked under reduced pressure. The suction arm 704 sucks the first surface or the second surface with the suction portion 704*b* to support the product-containing outer bag 300.

Figure 19:
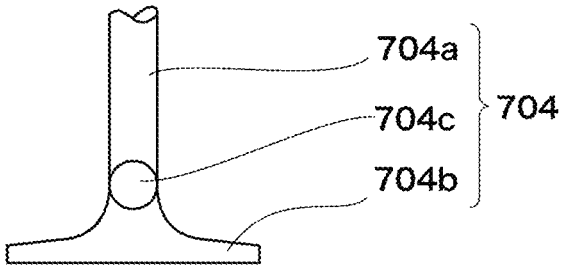
FIGS. 19(*a*) and 19(*b*) are schematic views for explaining a preferable form of the suction arm, in which FIG. 19(*a*) illustrates a horizontal state and FIG. 19(*b*) illustrates an inclined state.
Figure 19:
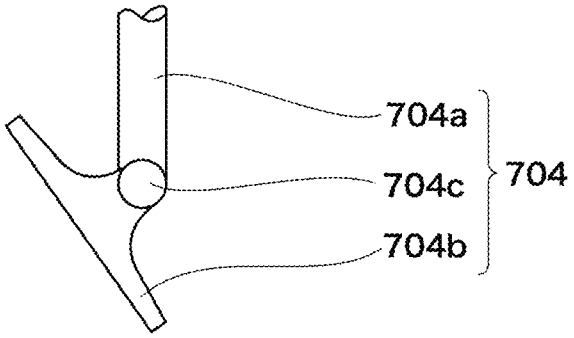

FIGS. 19(*a*) and 19(*b*) are schematic diagrams for explaining a preferable form of the suction arm, in which FIG. 19(*a*) illustrates a horizontal state and FIG. 19(*b*) illustrates an inclined state. The suction arm 704 preferably further includes an angle change portion 704*c*. The angle change portion 704*c* is a mechanism for changing an angle of the suction portion 704*b*, and for example, a rotary actuator may be provided as the angle change portion 704*c* at the boundary between the arm portion 704*a* and the suction portion 704*b*. Furthermore, the suction arm 704 may be hung on the circulating rail 908 as illustrated in FIG. 16 and move along the circulating rail 908, for example, or each suction arm 704 may be attached to a robot main body (not illustrated) and moved by the robot main body.

When the bag feeding device 900 includes the suction arm 704 as the holding instrument, a suction arm 902 that sucks a base material surface of the product-containing outer bag 300 stored in a supply unit 901 and conveys the base material surface to a conveyor 903, and the conveyor 903 that transfers the product-containing outer bag 300 in a standing state can be omitted as illustrated in FIG. 16.

Bag Feeding Device of Second Example

FIG. 20 is a partial schematic view illustrating a second example of the bag feeding device. As illustrated in FIG. 20, the bag feeding device 700 of the second example includes a suction arm 704 as a holding instrument. The suction arm 704 has the same configuration as the suction arm 704 illustrated in FIGS. 18 and 19. FIG. 20 illustrates, as an example, a mode in which one product-containing outer bag 300 is clamped by one set of two suction arms 704, but the present disclosure is not limited thereto. According to a length of the product-containing outer bag 300, one product-containing outer bag 300 may be clamped by one suction arm 704, or for example, one product-containing outer bag 300 may be clamped by one set of three suction arms 704.

In the bag feeding device 700 of the second example, the opening instrument 706 is similar to the opening instrument 906 of the bag feeding device 900 of the first example, and is, for example, a bar-shaped jig (illustrated in FIG. 20), a blade (not illustrated), or a suction instrument (not illustrated).

As illustrated in FIG. 20, the bag feeding device 700 of the second example preferably further includes a support base 710 that is applied to a surface opposite to a surface, sucked by the suction arm 704, of the product-containing outer bag 300 supported in a suspended state by the suction arm 704, and an inclined plate 711 that slides and guides the plurality of bags 3, coming out of the outer bag, to the belt conveyor 705. The support base 710 is a base disposed on an upper side of the belt conveyor 705. The inclined plate 711 is a plate-like member disposed between the support base 710 and the belt conveyor 705. The support base 710 and the inclined plate 711 may be separate bodies or may be integrated. When the support base 710 and the inclined plate 711 are separate bodies, the opening instrument 706 may be provided with a gap between the support base 710 and the inclined plate 711, and the L-shaped opening instrument 706 may slide in the gap.

As illustrated in FIG. 20, in the bag feeding device 700 of the second example according to the present embodiment, the receiving instrument is a belt conveyor 705, and the alignment instrument is an alignment guide 707 that corrects the posture of each of the bags 3 conveyed by the belt conveyor 705. As illustrated in FIG. 20, the alignment guide 707 is a plate-shaped member disposed on one side portion of the conveying surface of the belt conveyor 705 and at a predetermined inclination angle with respect to a flow direction D of the belt conveyor. The bag feeding device 700 preferably further includes an alignment wall 708, in addition to the alignment guide 707, as an alignment instrument. The alignment wall 708 extends in the flow direction D of the belt conveyor and on the side, opposite to the side on which the alignment guide 707 of the conveying surface of the belt conveyor 705 is arranged. The alignment guide 707 and the alignment wall 708 are fixed to a portion that does not move with the conveyance of the belt conveyor 705, and do not move with the conveyance of the belt conveyor 705. The alignment guide 707 and the alignment wall 708 are preferably not in contact with the conveying surface of the belt conveyor 705.

In the bag feeding device 700 of the second example, the belt conveyor 705 also serves as the supply instrument.

Bag Feeding Device of Third Example

FIG. 21 is a partial schematic view illustrating a third example of the bag feeding device. The basic configuration of the bag feeding device 800 of the third example is the same as that of the bag feeding device 700 of the second example, except that alignment instruments are different. Therefore, the description of the common configuration will be omitted, and different configurations will be described.

In the bag feeding device 800 of the third example according to the present embodiment, the receiving instrument is the belt conveyor 705, and the alignment instrument is an alignment rib 807 extending in the flow direction D of the belt conveyor 705 and on the conveying surface of the belt conveyor 705. The alignment rib 807 is disposed in a portion, corresponding to a falling point of the plurality of bags 3, on the conveying surface of the belt conveyor 705. A length of the alignment rib 807 in the flow direction D may be any length as long as all of the plurality of bags 3, coming out of one outer bag, can be received. In FIG. 21, as an example, a form in which the alignment ribs 807 are plate-like members is illustrated, but the present disclosure is not limited thereto. The alignment rib 807 may be, for example, a bar-shaped member (not illustrated). The alignment rib 807 is fixed to a portion that does not move with the conveyance of the belt conveyor 705, and does not move with the conveyance of the belt conveyor 705. The alignment rib 807 is preferably not in contact with the conveying surface of the belt conveyor 705.

(Supply Method of Bags)

Next, a method of supplying the bags, incorporated in the product-containing outer bag according to the present embodiment, will be described with reference to FIGS. 16, 17, 20, and 21. A supply method according to the present embodiment is a supply method of supplying the bags 3 by the bag feeding devices 700, 800, and 900 according to the present embodiment, and includes a step A of supporting the product-containing outer bag 300 in a suspended state by the holding instruments 704 and 904, a step B of opening the lower end of the product-containing outer bag 300 by the opening instruments 706 and 906 and dropping the plurality of bags 3, a step C of receiving the plurality of dropped bags 3 by the receiving instruments 705 and 905, a step D of aligning the plurality of bags 3 in a line by the alignment instruments 707, 807, and 905, and a step E of sequentially supplying the bags 3 aligned in a line to the filling machine by the supply instruments 705 and 907.

In the supply method according to the present embodiment, as illustrated in FIGS. 16 and 17, the bag feeding device 900 of the first example includes a mode in which the clamping arm 904 is provided as a holding instrument, and the step A is a step of clamping the product-containing outer bag 300 with the clamping arm 904.

In the supply method according to the present embodiment, as illustrated in FIGS. 16 and 17, the bag feeding device 900 of the first example includes a mode in which the guide rail 905, holding and transferring the plurality of bags 3 in a standing state, is disposed as the receiving instrument, and the step C and the step D are a step of simultaneously receiving and aligning the plurality of bags 3 by the guide rail 905.

Next, a method of supplying the bags incorporated in the product-containing outer bag according to the present embodiment will be described with reference to FIGS. 16 and 17. FIGS. 16 and 17 illustrate, as an example, a mode in which a product-containing outer bag is the product-containing outer bag (third example) 300 illustrated in FIG. 11. Preferably, the supply method of bags according to the present embodiment includes: a step A in which the bag feeding device includes the clamping arm 904 having the engaging claw 904*a* and the guide rail 905 holding the plurality of bags 3 in a standing state, and the clamping arm 904 lifts the product-containing outer bag 300 by engaging the engaging claw 904*a* with the thick portion 4 while clamping the first side 11 of the product-containing outer bag 300 according to the present embodiment; a step B in which the plurality of bags 3 are dropped into the guide rail 905 by opening the second side 12; and a step C in which the bags 3 are sequentially supplied from the guide rail 905 to the filling machine.

For example, as illustrated in FIG. 16, the bag feeding device 900 preferably includes the suction arm 902, the conveyor 903, the clamping arm 904, and the guide rail 905. The suction arm 902 is a robot arm that sucks the surface of the base material of the product-containing outer bag 300 stored in the supply unit 901 and that carries the outer bag to the conveyor 903. The conveyor 903 is a device that transfers the product-containing outer bag 300, and transfers the product-containing outer bag 300, in a state where the product-containing outer bag 300 is standing, so that the first side 11 faces upward, so that the clamping arm 904 can clamp the first side 11 of the product-containing outer bag. The clamping arm 904 is a robot arm that has an engaging claw 904*a* and that clamps and lifts the product-containing outer bag 300. The guide rail 905 is a rail capable of holding and transferring the plurality of bags 3 as products in a standing state.

In FIG. 16, a predetermined number of the product-containing outer bags 300 are stored in the supply unit 901 such as cardboard, trays, or pallets. First, the suction arm 902 sucks up the product-containing outer bag 300 from the supply unit 901 and places the outer bag on the conveyor 903. The conveyor 903 moves the product-containing outer bag 300 in a standing state where the first side 11 is on the upper side. Next, the engaging claw 904*a* is engaged with the first fitting tool 14 while the clamping arm 904 clamps the first side 11 of the product-containing outer bag 300, and the product-containing outer bag 300 is lifted up such that the second side 12 is on the lower side. Although the plurality of bags 3 (for example, 100 bags) are incorporated in the product-containing outer bag 300, the outer bag can be more reliably clamped by the clamping arm 904 by engaging the engaging claw with the first fitting tool 14. Furthermore, since the bags 3, which are products, are moved toward the second side 12 and aligned by gravity, no manual realignment is needed. In the product-containing outer bag 300, for example, a weak engagement portion is disposed at a portion adjacent to the right adhesive seal 13B of the second fitting tool 24, and the weak engagement portion is opened. The weak engagement portion can be opened by moving the base materials 5*a* and 5*b* (illustrated in FIG. 12) in directions away from each other using, for example, a suction board or the like. Since the weak engagement portion weakens the engagement force, there is almost no impact at the time of opening, and the alignment of the bags 3 as products is not disturbed. Next, as illustrated in FIG. 17(*a*), a rod-shaped jig 906 is inserted into the opening of the weak engagement portion. When the rod-shaped jig 906 is slid from a side of the right adhesive seal 13B to a side of the left adhesive seal 13A or the product-containing outer bag 300 is slid from the left side to the right side of the sheet of drawing, the engagement of the second fitting tool 24 is released, the second opening 7 (illustrated in FIG. 12) is opened, and the plurality of bags 3 is supplied into the guide rail 905 by natural fall as illustrated in FIG. 17(*b*). At this time, since the bags 3 are disposed away from the adhesive seal 13 by the auxiliary seal 15 in the outer bag 10C, the alignment of the bags 3 is not disturbed by being caught by the intersection between the second fitting tool 24 and the adhesive seal 13. The bags 3 aligned in the standing state in the guide rail 905 are guided with the standing state changed to the lying state in accordance with the belt operation, and are supplied to the filling machine in the aligned state. In this manner, the product-containing outer bag 300 can automatically perform from boxing to supplying to filling machine. Since the bags 3, which are products, are aligned without requiring manpower, it is performable to eliminate manpower shortage, reduce labor costs, and avoid loss due to work errors. Furthermore, since the outer bag 10C is reusable, it can contribute to the achievement of sustainable development goals (SDGs).

In FIGS. 16 and 17, a form in which the bags 3 vertically fall from the outer bag 10C into the guide rail 905 is illustrated, but the present disclosure is not limited thereto. An inclined plate (not illustrated) stretched across an upper surface opening of the guide rail 905 may be provided, and the plurality of bags 3 coming out from the outer bag 10C may slide on the inclined plate and be guided into the guide rail 905.

When the bag feeding device 900 of the first example includes the suction arm 704 as illustrated in FIGS. 18 and 19, instead of the clamping arm 904, as the holding instrument, the suction arm 704 sucks the surface of the base material of the product-containing outer bag 300 stored in the supply unit 901 illustrated in FIG. 16 in the horizontal state illustrated in FIG. 19(*a*) and moves above the guide rail 905, and in the inclined state illustrated in FIG. 19(*b*), the second side 12 is suspended so as to be lower than the first side 11. The suspension includes a form in which the product-containing outer bag 300 is inclined and hung down as illustrated in FIG. 20 and a form in which the outer bag is vertically hung down as illustrated in FIG. 17. Regarding timing, the suction arm 704 may change from the horizontal state to the inclined state after moving the suction arm to the upper side of the guide rail 905, immediately after lifting the product-containing outer bag 300 from the supply unit 901, or in the middle of the movement from the bag supply unit 901 to the upper side of the guide rail 905. When the holding instrument is the suction arm 704, the product-containing outer bags 100, 200 and 300 are a decompression bag having a portion where inner walls of the base material 5 constituting the outer bags 10A, 10B, and 10C are in contact with each other, so that the suction arm 704 can more reliably support the product-containing outer bags 100, 200, and 300.

So far, with respect to the product-containing outer bag 300 of the third example, a mode has been described in which a portion clamped by the clamping arm 904 of the bag feeding device 900 is the first side 11, a portion engaged with the engaging claw 904*a* of the clamping arm 904 is the first fitting tool 14, and the take-out port for the plurality of bags 3 is on the second side 12, but the present disclosure is not limited thereto. In the product-containing outer bag 300 of the third example, a portion clamped by the clamping arm 904 of the bag feeding device 900 may be the second side 12, a portion engaged with the engaging claw 904*a* of the clamping arm 904 may be the second fitting tool 24, and the take-out port for the plurality of bags 3 may be on the first side 11. Furthermore, When the adhesive seal is a thermal seal with weakened seal strength such as a low-temperature thermal seal, the plurality of bags 3 may be taken out and supplied to the filling machine by opening the thermal seal.

When the outer bag 10C has a perforation extending, in parallel with the first fitting tool 14, on a side closer to the second side 12 side than the first fitting tool 14 or a perforation extending, in parallel with the second fitting tool 24, on a side closer to the first side 11 than the second fitting tool 24, the bag feeding device 900 may have a pulling jig (not illustrated) having a chuck and a lifting and lowering unit as the opening instrument 906, and may pick a portion where the bags 3 do not exist of a portion below the perforation of the outer bag 10C, using the chuck, and the lifting and lowering unit may move the chuck downward to separate the lower side of the perforation of the outer bag 10C and open the lower end of the outer bag 10C.

Regarding the product-containing outer bag 100 of the first example and the product-containing outer bag 200 of the second example, the basic flow of the method of supplying the bags is the same as that of the product-containing outer bag 300 of the third example, but different points will be mainly described. In the product-containing outer bag 100 of the first example, a portion clamped by the clamping arm 904 of the bag feeding device 900 is the standing portion 16, and a portion engaged with the engaging claw 904*a* of the clamping arm 904 is the thick portion 4. Furthermore, the take-out port for the plurality of bags 3 is on either the first side 11 or the second side 12. The product-containing outer bag 100 lifted by the clamping arm 904 is inclined such that either the first side 11 or the second side 12 faces downward, and the plurality of bags 3 is supplied into the guide rail 905 of the bag feeding device 900 by natural fall by opening the lower side of the first side 11 or the second side 12 with a blade or opening a fragile portion provided on the lower side of the first side 11 or the second side 12. The bags 3 aligned in the standing state in the guide rail 905 are guided with the standing state changed to the lying state in accordance with the belt operation, and are supplied to the filling machine in the aligned state. In this manner, the product-containing outer bag 100 can automatically perform from boxing to supplying to filling machine.

In the product-containing outer bag 200 of the second example, a portion clamped by the clamping arm 904 of the bag feeding device 900 is the first side 11, and a portion engaged with the engaging claw 904*a* of the clamping arm 904 is the thick portion 4. Furthermore, the take-out port for the plurality of bags 3 is on the second side 12. The product-containing outer bag 200 is lifted by the clamping arm 904 such that the second side 12 faces downward, and the plurality of bags 3 is supplied into the guide rail 905 of the bag feeding device 900 by natural fall by opening the second side 12 with a knife or opening a fragile portion disposed on the second side 12. The bags 3 aligned in the standing state in the guide rail 905 are guided with the standing state changed to the lying state according to the belt operation, and are supplied to the filling machine in the aligned state. In this manner, the product-containing outer bag 200 can automatically perform from boxing to supplying to filling machine.

Furthermore, the bag feeding device 900 may include a suction instrument (not illustrated) as the opening instrument 906, and may separate the first surface and the second surface with the suction instrument to peel off an easy peel seal (not illustrated) disposed in the second opening or the second opening and the adhesive seal 13 (13A, 13B) to open the second opening.

Furthermore, when the outer bags 10A and 10B have perforations parallel to the thick portion 4, the bag feeding device 900 may have a pulling jig (not illustrated) having a chuck and a lifting and lowering unit, as the opening instrument 906, and may pick a portion where the bags 3 do not exist of a portion below the perforations of the outer bags 10A and 10B with the chuck, and the lifting and lowering unit may move the chuck downward to separate the lower sides of the perforations of the outer bags 10A and 10B from each other and open the lower ends of the outer bags 10A and 10B.

Although the bag supply method using the bag feeding device 900 of the first example has been described so far, the basic flow of the bag supply method using the bag feeding device 700 of the second example (illustrated in FIG. 20) or the bag feeding device 800 of the third example (illustrated in FIG. 21) is the same as that of the bag feeding device 900 of the first example. Therefore, the description of the common configuration will be omitted, and different configurations will be described.

In the supply method according to the present embodiment, as illustrated in FIG. 20, the bag feeding device 700 of the second example includes a form in which the suction arm 704 is provided as the holding instrument, and the step A is a step of sucking the product-containing outer bag 300 with the suction arm 704. When using the bag feeding device 700 of the second example, the suction arm 704 sucks the base material surface of the product-containing outer bag 300, stored in the supply unit 901 illustrated in FIG. 16, in the horizontal state illustrated in FIG. 19(*a*) and moves to the upper side of the belt conveyor 705, and in the inclined state illustrated in FIG. 19(*b*), the second side 12 is suspended so as to be lower than the first side 11. The suspension includes a form in which the product-containing outer bag 300 is inclined and hung down as illustrated in FIG. 20 and a form in which the outer bag is vertically hung down as illustrated in FIG. 17. Regarding timing, the suction arm 704 may change from the horizontal state to the inclined state after moving the suction arm to the upper side of the belt conveyor 705, immediately after lifting the product-containing outer bag 300 from the supply unit 901, or in the middle of the movement from the bag supply unit 901 to the upper side of the belt conveyor 705.

In the step B, when the suction arm 704 is inclined above the belt conveyor 705, the suction arm 704 is preferably operated to press the product-containing outer bag 300 against the support base 710. Since the bag feeding device 700 of the second example has the support base 710, the product-containing outer bag 300 is supported from both surfaces by the suction arm 704 and the support base 710. Therefore, the opening of the product-containing outer bag 300 by the opening instrument 706 can be more stably performed. Furthermore, in the step B, it is preferable that the bags 3, coming out of the opened outer bag, slide on the inclined plate 711 and move toward the belt conveyor 705. Since the bag feeding device 700 of the second example includes the inclined plate 711, it is possible to guide the plurality of bags 3, coming out of the outer bag, onto the belt conveyor 705 without greatly disturbing the alignment state.

In the supply method according to the present embodiment, the bag feeding device 700 of the second example includes a mode in which the belt conveyor 705 is provided as a receiving instrument and the alignment guide 707, correcting the posture of each of the bags 3 conveyed by the belt conveyor 705, is provided as an alignment instrument, the step C is a step of receiving the plurality of bags 3 by the belt conveyor 705, and the step D is a step of bringing the bags 3 into contact with the alignment guide 707 and aligning the bags 3. The conveyed bags 3 abut on the alignment guide 707 and move along the alignment guide 707 to be aligned in a line in the flow direction D. At this time, since the bag feeding device 700 of the second example further includes the alignment wall 708 as the alignment instrument, the bags 3 moved by the alignment guide 707 can abut on the alignment wall 708, and the bags 3 can be more cleanly aligned.

The bags 3 aligned on the belt conveyor 705 by the alignment instrument are supplied to the filling machine while being aligned in accordance with the belt operation. As described above, the supply method in accordance with the present embodiment can automatically perform from boxing to supplying to filling machine.

The bag supply method using the bag feeding device 800 of the third example is the same as the bag supply method using the bag feeding device 700 of the second example, except that the step C and the step D are different. In the supply method according to the present embodiment, as illustrated in FIG. 21, the bag feeding device 800 of the third example includes a form in which the belt conveyor 705 is provided as a receiving instrument, and the alignment rib 807, extending in the flow direction D of the belt conveyor 705, on the conveying surface of the belt conveyor 705 is provided as an alignment instrument, and the step C and the step D are steps of receiving the plurality of bags 3 by the belt conveyor 705 and simultaneously bringing the plurality of bags 3 into contact with the alignment rib 807 and aligning the plurality of bags 3. The falling bags 3 are aligned in a line in the flow direction D by abutting on the alignment ribs 807.

In the bag feeding devices 700, 800, and 900 according to the present embodiment, the holding instrument may be a hanging member (not illustrated) such as a hook. When the holding instrument is a hanging member, the product-containing outer bags 100, 200, and 300 preferably have hanging holes (not illustrated), as held portions, engaging with the hanging member. In this example, the bags can be supplied in a similar manner to the above-described supply method, except that the hanging member is hooked on the hanging holes of the product-containing outer bags 100, 200, and 300 stored in the supply unit 901 to support the product-containing outer bags 100, 200, and 300 in a suspended state and move to the upper side of the belt conveyor 705.

REFERENCE SIGNS LIST

100, 200, 300 Product-containing outer bag
p1, p2, p3, p4, . . . , pn Bag
3 A plurality of bags (bags)
4 Thick portion
5 Base material
5*a* First base material
5*b* Second base material
6 Opening, first opening
6*a* Edge of opening, edge of first opening
7 Second opening

7*a* Edge of second opening
8 Opening
9 Chuck
10A, 10B, 10C Outer bag
11 First side
12 Second side
13 Adhesive seal
13A Left adhesive seal
13B Right adhesive seal
14 Fitting tool, first fitting tool
14*a* Male member
14*a*1 Male base
14*a*2 Male portion
14*b* Female member
14*b*1 Female base
14*b*2 Female portion
14*c* Male portion
14*d* Female portion
15 Auxiliary seal
16 Standing portion
24 Second fitting tool
40 Non-arrangement portion
43 Heat sealer
50, 54, 57 Wound product of product-containing outer bag
51, 52, 56 Bobbin
53, 55 Outer bag-wound product
61*a*, 61*b* Dance roll
62*a*, 62*b*, 62*c* Pinch roll
63, 63*b* Claw guide roll
64 Touch roll
65 Conveyance conveyor
66 Claw opening
67 Claw hook
68 Alignment device
700 Bag feeding device
704 Suction arm
704*a* Arm portion
704*b* Suction portion
704*c* Angle change portion
705 Belt conveyor
706 Opening instrument
707 Alignment guide
708 Alignment wall
710 Support base
711 Inclined plate
800 Bag feeding device
807 Alignment rib
900 Bag feeding device
901 Supply unit
902 Suction arm
903 Conveyor
904 Clamping arm
904*a* Engaging claw
905 Guide rail
906 Opening instrument
907 Supply instrument
908 Circulating rail
T Containing portion
X Alignment direction of plurality of bags, length direction of cylinder
Y Longitudinal direction of base material 5

What is claimed is:

1. A product-containing outer bag in which a plurality of bags, as products, stacked in a row continuously or intermittently, with the bags partially overlapping each other, are wrapped and integrated with an outer bag, for outer packaging, having a resin film as a base material such that a state of stacking the bags is maintained, wherein the outer bag includes: a first side; a second side opposite to the first side; an adhesive seal connecting an end of the first side and an end of the second side opposite to each other; and a held portion that is held upon supporting the product-containing outer bag in a state of being suspended such that the second side is below the first side, where in an auxiliary seal is disposed integrally with the adhesive seal, or an auxiliary seal is provided separately from the adhesive seal, wherein the second side is a second folded portion in which one base material is folded back along an edge of the second side, and the auxiliary seal does not extend all the way from the first side to the second folded portion; or wherein the second side has a second opening that opens along an edge of the second side, and a second fitting tool that is disposed on an inner wall side of the base material and along an edge of the second opening, and the second opening is closed by engaging the second fitting tool, and the auxiliary seal does not extend all the way from the first side to the second fitting tool.

2. The product-containing outer bag according to claim 1, wherein the outer bag further includes a thick portion disposed along an edge of the first side.

3. The product-containing outer bag according to claim 2, wherein the outer bag includes a first opening opened along an edge of the first side, and a first fitting tool disposed, as the thick portion, on an inner wall side of the base material along an edge of the first opening, and the first fitting tool is engaged.

4. The product-containing outer bag according to claim 2, wherein the outer bag further includes a first opening opened along an edge of the first side, a first fitting tool disposed, as the thick portion, on an inner wall side of the base material along an edge of the first opening, wherein the outer bag includes the second side has the second opening that opens along the edge of the second side, and the second fitting tool that is disposed on the inner wall side of the base material and along the edge of the second opening, the first fitting tool is engaged and the second fitting tool is engaged, and one or both of the first fitting tool and the second fitting tool include a weak engagement portion in one or both of portions adjacent to the adhesive seal.

5. The product-containing outer bag according to claim 4, wherein the outer bag includes a perforation extending, in parallel with the first fitting tool, on a side closer to the second side than the first fitting tool, or a perforation extending, in parallel with the second fitting tool, on a side closer to the first side than the second fitting tool.

6. The product-containing outer bag according to claim 4, wherein with a proviso that a distance between an edge of the first side and the thick portion is d1, and a distance between an edge of the second side and the second fitting tool is d2, a relationship of $d1<d2$ is satisfied.

7. The product-containing outer bag according to claim 1, wherein the outer bag includes the second side has the second opening that opens along the edge of the second side, and an easy peel seal sealing the second opening.

8. The product-containing outer bag according to claim 1, wherein the outer bag includes a perforation along an edge of the second side.

9. The product-containing outer bag according to claim 1, wherein the outer bag includes a standing portion that is positioned at a portion sandwiched between the first side and the second side and is parallel to the first side and the second side.

10. The product-containing outer bag according to claim 9, wherein the outer bag further includes a thick portion disposed along an edge of the standing portion.

11. The product-containing outer bag according to claim 1, wherein the outer bag includes a portion where inner walls of the base material are in contact with each other.

12. The product-containing outer bag according to claim 1, wherein the outer bag includes the second opening opened along an edge of the second side and the second fitting tool disposed on an inner wall side of the base material along an edge of the second opening, and wherein the auxiliary seal is provided closer to the first side than the second fitting tool.

13. The product-containing outer bag according to claim 1, wherein a region S, on which the auxiliary seal is disposed, is a portion at a predetermined interval from the edge of the second side and a portion at a predetermined interval from the edge of the first side.

14. The product-containing outer bag according to claim 1, wherein the auxiliary seal is disposed integrally with the adhesive seal.

15. The product-containing outer bag according to claim 1, wherein the first side and the second side are closed, wherein the auxiliary seal does not extend all the way from the first side to the second side.

16. The product-containing outer bag according to claim 1, wherein the first side is a first folded portion in which one base material is folded back along an edge of the first side; or the first side has a first opening that opens along an edge of the first side, and a first fitting tool that is disposed on an inner wall side of the base material and along an edge of the first opening, and the first opening is closed by engaging the first fitting tool;

wherein the auxiliary seal does not extend all the way from the first folded portion or the first fitting tool to the second folded portion or the second fitting tool.

17. A bag feeding device that sequentially supplies to a filling machine a plurality of bags, as products, incorporated in a product-containing outer bag in which the plurality of bags stacked in a row continuously or intermittently, with the bags partially overlapping each other, are wrapped and integrated with an outer bag, for outer packaging, having a resin film as a base material such that a state of stacking the bags is maintained, the bag feeding device comprising:

a holding instrument that supports the product-containing outer bag in a suspended state;

an opening instrument that opens a lower end of the product-containing outer bag supported in a suspended state;

a receiving instrument that receives the plurality of bags coming out of the outer bag;

an alignment instrument that aligns the plurality of bags; and a supply instrument that supplies the aligned bags to the filling machine.

18. The bag feeding device according to claim 17, wherein the holding instrument is a clamping arm.

19. The bag feeding device according to claim 17, wherein the holding instrument is a suction arm.

20. The bag feeding device according to claim 17, wherein the receiving instrument is a guide rail that holds and transfers the plurality of bags in a standing state, and the guide rail also serves as the alignment instrument.

21. The bag feeding device according to claim 17, wherein the receiving instrument is a belt conveyor, and the alignment instrument is an alignment rib extending on a conveyance surface of the belt conveyor and in a flow direction of the belt conveyor.

22. The bag feeding device according to claim 17, wherein the receiving instrument is a belt conveyor, and the alignment instrument is an alignment guide that corrects a posture of each of the bags conveyed by the belt conveyor.

23. A supply method of supplying the bags with the bag feeding device according to claim 17, the supply method comprising:

a step A of supporting the product-containing outer bag in a suspended state by the holding instrument;

a step B of opening the lower end of the product-containing outer bag by the opening instrument to drop the plurality of bags;

a step C of receiving the plurality of dropped bags by the receiving instrument;

a step D of aligning the plurality of bags in a line by the alignment instrument; and a step E of sequentially supplying the bags aligned in a line to the filling machine by the supply instrument.

24. The supply method according to claim 23, wherein the bag feeding device includes a clamping arm as the holding instrument, and the step A is a step of clamping the product-containing outer bag with the clamping arm.

25. The supply method according to claim 23, wherein the bag feeding device includes a suction arm as the holding instrument, and the step A is a step of sucking the product-containing outer bag with the suction arm.

26. The supply method according to claim 23, wherein the bag feeding device includes a guide rail, as the receiving instrument, holding and transferring the plurality of bags in a standing state, and the step C and the step D are steps of simultaneously receiving and aligning the plurality of bags by the guide rail.

27. The supply method according to claim 23, wherein the bag feeding device includes a belt conveyor as the receiving instrument, and an alignment rib, as the alignment instrument, extending on a conveyance surface of the belt conveyor and in a flow direction of the belt conveyor, and the step C and the step D are steps of receiving the plurality of bags by the belt conveyor and bringing the plurality of bags into contact with the alignment rib and aligning the plurality of bags, simultaneously.

28. The supply method according to claim 23, wherein the bag feeding device includes a belt conveyor as the receiving instrument, and an alignment guide, as the alignment instrument, correcting a posture of each of the bags conveyed by the belt conveyor, the step C is a step of receiving the plurality of bags by the belt conveyor, and the step D is a step of bringing the bags into contact with the alignment guide and aligning the bags.

* * * * *